US006526246B2

(12) United States Patent
Iwata et al.

(10) Patent No.: US 6,526,246 B2
(45) Date of Patent: Feb. 25, 2003

(54) POWDER REPLENISHING DEVICE, POWDER CONVEYING DEVICE, DEVELOPING APPARATUS USING THE SAME POWDER REPLENISHING DEVICE OR POWDER CONVEYING DEVICE, AND IMAGE FORMING APPARATUS USING THE SAME POWDER REPLENISHING DEVICE OR POWDER CONVEYING DEVICE

(75) Inventors: Nobuo Iwata, Sagamihara (JP); Nobuo Kasahara, Yokohama (JP); Satoshi Muramatsu, Yokohama (JP); Junichi Matsumoto, Kawasaki (JP); Tomoyuki Ichikawa, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/917,930

(22) Filed: Jul. 31, 2001

(65) Prior Publication Data

US 2002/0025195 A1 Feb. 28, 2002

(30) Foreign Application Priority Data

Jul. 31, 2000 (JP) ..... 2000-230582

(51) Int. Cl.[7] ..... G03G 15/08

(52) U.S. Cl. ..... 399/258; 222/DIG. 1; 399/120; 399/261; 399/262

(58) Field of Search ..... 222/DIG. 1, 161; 399/111, 119, 120, 258, 260, 261, 262

(56) References Cited

U.S. PATENT DOCUMENTS

| | | | | |
|---|---|---|---|---|
| 4,835,582 A | | 5/1989 | Kasahara et al. | |
| 4,908,661 A | | 3/1990 | Iwata et al. | |
| 5,008,711 A | | 4/1991 | Sakamoto et al. | |
| 5,162,859 A | | 11/1992 | Hirono et al. | |
| 5,386,274 A | * | 1/1995 | Sanpe et al. | |
| 5,663,788 A | * | 9/1997 | Sanpe | |
| 5,875,380 A | * | 2/1999 | Iwata et al. | |
| 5,953,567 A | * | 9/1999 | Muramatsu et al. | |
| 5,962,783 A | * | 10/1999 | Iwata et al. | |
| 5,987,298 A | * | 11/1999 | Muramatsu et al. | |
| 6,112,046 A | * | 8/2000 | Suzuki et al. | |
| 6,128,459 A | | 10/2000 | Iwata et al. | |
| 6,142,690 A | * | 11/2000 | Yoshimura et al. | |
| 6,163,669 A | * | 12/2000 | Aoki et al. | |
| 6,201,941 B1 | * | 3/2001 | Kasahara et al. | |
| 6,295,437 B1 | * | 9/2001 | Hodoshima et al. | |
| 6,308,027 B1 | | 10/2001 | Obu et al. | |
| 6,314,261 B1 | * | 11/2001 | Omata et al. | 399/258 |
| 6,381,435 B2 | * | 4/2002 | Shinohara et al. | |
| 6,393,241 B1 | * | 5/2002 | Matsumoto et al. | |

FOREIGN PATENT DOCUMENTS

| | | |
|---|---|---|
| JP | 9-244372 | 9/1997 |
| JP | 11-143194 | 5/1999 |
| JP | 2000-356898 | 12/2000 |

* cited by examiner

*Primary Examiner*—Hoane Ngo
(74) *Attorney, Agent, or Firm*—Oblon, Spivak, McClelland, Maier & Neustadt, P.C.

(57) ABSTRACT

The powder container includes a powder discharging outlet at one end portion of one side wall of the powder container. The powder replenishing device further includes a reciprocating motion device that reciprocates the powder container between forward and backward directions with respect to a moving direction of the powder toward the powder discharging outlet so as to move the powder in the powder container toward the powder discharging outlet in a state that the powder discharging outlet is directed downward in substantially a vertical direction.

68 Claims, 12 Drawing Sheets

POWDER REPLENISHING DEVICE, POWDER CONVEYING DEVICE, DEVELOPING APPARATUS USING THE SAME POWDER REPLENISHING DEVICE OR POWDER CONVEYING DEVICE, AND IMAGE FORMING APPARATUS USING THE SAME POWDER REPLENISHING DEVICE OR POWDER CONVEYING DEVICE

BACKGROUND OF THE INVENTION

1. Field of the Invention

The present invention relates to an image forming apparatus and a developing apparatus, in which a developing device develops an electrostatic latent image formed on an image bearing member with powder to form a visible image. Further, the present invention relates to a powder replenishing device that replenishes the developing device with powder contained in a powder container, and a powder conveying device that conveys powder to the developing device.

2. Discussion of the Background

In an image forming apparatus such as a copying machine, a printer, a facsimile, or the like, a toner replenishing device has been used to replenish a developing device with toner contained in a replaceable toner container. In such a toner replenishing device, when all the toner in the toner container is consumed, the toner container is replaced with a new one.

As an example of the above-described toner replenishing device, FIG. 15 illustrates a toner container 111 including a movable member 112 such as a screw and a coil spring. In the toner replenishing device of FIG. 15, the toner in the toner container 111 is conveyed toward a toner discharging outlet (111*a*) by rotating a rotation shaft (112*a*) of the movable member 112. Subsequently, the toner is discharged from the toner container 111 through the toner discharging outlet (111*a*) and is replenished to a developing device.

As another example of the toner replenishing device, FIG. 16 illustrates a screw bottle 211 as a cylindrical toner container. In the screw bottle 211, a protrusion 212 is spirally provided on a circumferential inner surface of the screw bottle 211 along a circumferential direction. The toner in the screw bottle 211 is conveyed toward a toner discharging outlet (211*a*) by rotating the screw bottle 211. Subsequently, the toner is discharged from the screw bottle 211 through the toner discharging outlet (211*a*) and is replenished to a developing device.

In the toner container 111 of FIG. 15, because the movable member 112 needs to be provided to discharge the toner from the toner container 111, the total replacement cost for the toner container 111 typically increases. Further, the movable member 112 is driven by a driving source disposed outside of the toner container 111, and an opening for connection is formed with the toner container 111. For this opening, a seal member needs to be provided to seal the opening, thereby increasing complexity of the construction of the toner container 111.

Further, in the screw bottle 211 of FIG. 16, because the protrusion 212 needs to be spirally provided on the circumferential inner surface of the screw bottle 211, the construction of the screw bottle 211 may not be simplified.

Through intense study, the inventors have developed a toner replenishing device that replenishes a developing device with toner contained in a toner container of simple and low-cost construction without a spiral protrusion therein.

The toner replenishing device developed by the inventors employs a rectangular parallelepiped shaped toner container of simple and low-cost construction, and a reciprocating motion device that reciprocates the toner container to move the toner in the toner container toward a toner discharging outlet formed with the toner container. In this toner replenishing device, the toner in the toner container is gradually moved toward the toner discharging outlet by an inertial force of the toner produced when the toner container reciprocates. Then, the toner is discharged from the toner container through the toner discharging outlet.

The above-described toner replenishing device substantially eliminates the problems of the background toner replenishing devices, such as, the complexity of the construction of the toner container and the increase of total replacement cost for the toner container. However, another problem arises in the above-described toner replenishing device, that is, the toner in the toner container may not be properly discharged from the toner container depending on the position of the toner discharging outlet.

Specifically, as illustrated in FIG. 17, when a toner discharging outlet (311*a*) is formed at a lower part of one end wall of a toner container 311, a toner (T), which is gradually moved toward the one end wall by reciprocating motions of the toner container 311, cumulates around the toner discharging outlet (311*a*) after the toner (T) has hit against the one end wall. Thereafter, the cumulated toner (T) is typically compressed by gravity. As a result, the compressed toner (T) may block the toner discharging outlet (311*a*), and a toner replenishing amount may be decreased due to production of an aggregated toner mass larger than the toner discharging outlet (311*a*). Thus, the toner (T) may not be properly discharged from the toner container 311.

The above-described problems of the toner replenishing device may also occur in a powder replenishing device that replenishes a developing device with powder contained in a powder container by reciprocating the powder replenishing device.

As a technology relating to the present invention, Japanese Laid-open Patent Publication No. 9-244372 describes a toner feeding device. The contents of this reference are incorporated herein by reference in their entirety. This device includes a replaceable toner container, an engaging device which engages the toner container with the toner feeding device, and a reciprocating oscillation supplying device that supplies the reciprocating oscillation to the toner container so as to move a toner in the toner container toward a toner discharging outlet. Further, in the toner feeding device, grooves orthogonal to the direction of the reciprocating oscillation are provided on an inner wall of the toner container.

Moreover, in the toner feeding device of JP9-244372, the toner discharging outlet is formed at an upper part of one end wall of the toner container, and a plurality of grooves are provided on the inner wall of the toner container which inclines upwardly toward the toner discharging outlet. The toner in the toner container climbs over each groove and is moved to the toner discharging outlet by the reciprocating oscillation of the toner container.

In the toner feeding device thus constructed, because the toner is neither cumulated nor compressed around the toner discharging outlet, problems, such as an occurrence of blockage in a toner discharging outlet due to a compressed toner, and a decrease of toner replenishing amount due to production of an aggregated toner mass larger than a toner discharging outlet, are prevented.

On the other hand, because the above-described toner feeding device has a special construction such as a plurality of grooves on the inner wall of the toner container, the construction of the toner container is complex, so that a total replacement cost for the toner container increases.

In addition to the toner replenishing device, the inventors have developed a toner conveying device that conveys toner to a developing device. The toner conveying device includes a toner conveying path member forming a toner conveying path having an inlet and an outlet. The toner conveying path member is disposed such that a bottom surface of the toner conveying path member is in substantially a horizontal position. The toner conveying device further includes a reciprocating motion device that reciprocates the toner conveying path member in substantially a horizontal direction so as to move the toner in the toner conveying path member toward the outlet.

In the toner conveying device thus constructed, the toner in the toner conveying path member is gradually moved toward the outlet of the toner conveying path member by an inertial force of the toner in the toner conveying path member produced when the toner conveying path member reciprocates. Then, the toner is conveyed to the developing device through the outlet.

For reducing the size of the toner conveying device thus constructed, the size of the toner conveying path member is desired to be small. Further, for reducing the size of the toner conveying path member, the toner conveying path member should be constructed such that a cross-sectional area of the toner conveying path member in a direction perpendicular to the toner conveying direction is small.

However, as the cross-sectional area of the toner conveying path member in a direction perpendicular to the toner conveying direction becomes smaller, the contact area of toner with the toner conveying path member increases on condition that the toner conveying amount is held constant. The increase of the contact area of toner with the toner conveying path member causes a frictional resistance between the toner and the toner conveying path member to increase. As a result, the toner in the toner conveying path member may not be smoothly conveyed toward the outlet.

The above-described problem of the toner conveying device may also occur in a powder conveying device that conveys powder in a powder conveying path member to a developing device by reciprocating the powder conveying path member.

SUMMARY OF THE INVENTION

According to one aspect of the present invention, a powder replenishing device includes a powder container configured to contain powder, the powder container includes a powder discharging outlet at one end portion of one side wall of the powder container. The powder replenishing device further includes a reciprocating motion device configured to reciprocate the powder container between forward and backward directions with respect to a moving direction of the powder toward the powder discharging outlet so as to move the powder in the powder container toward the powder discharging outlet in a state that the powder discharging outlet is directed downward in substantially a vertical direction.

According to another aspect of the present invention, a powder conveying device includes a powder conveying path member configured to convey powder therethrough. The powder conveying path member includes one side wall and forms a powder conveying path having an inlet and an outlet. The outlet is directed downward in substantially a vertical direction. The powder conveying device further includes a reciprocating motion device configured to reciprocate the powder conveying path member between forward and backward directions with respect to a moving direction of the powder toward the outlet so as to move the powder in the powder conveying path member toward the outlet. The powder conveying path member is provided such that the one side wall inclines downwardly toward the outlet.

According to another aspect of the present invention, a method of replenishing powder to a developing device of an image forming apparatus includes containing the powder in a powder container having a powder discharging outlet, and reciprocating the powder container between forward and backward directions with respect to a moving direction of the powder toward the powder discharging outlet so as to move the powder in the powder container toward the powder discharging outlet.

According to another aspect of the present invention, a method of conveying powder through a powder conveying path member having an outlet to a developing device of an image forming apparatus, includes reciprocating the powder conveying path member between forward and backward directions with respect to a moving direction of the powder toward the outlet so as to move the powder in the powder conveying path member toward the outlet, and falling the powder through the outlet to the developing device.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
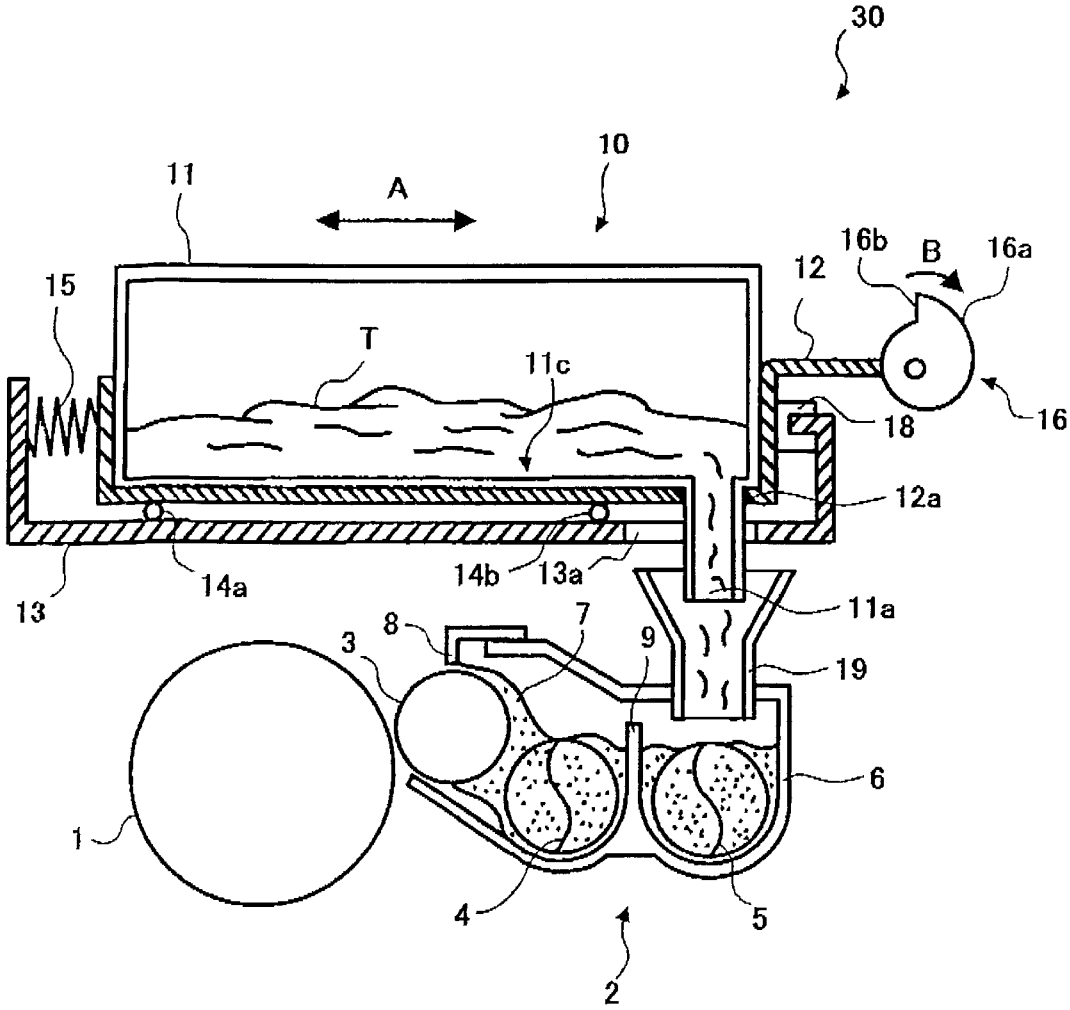
FIG. 1 is a schematic view of an image forming section of a copier according to an embodiment of the present invention.

Preferred embodiments of the present invention in which a powder replenishing device of the present invention is applied to a toner replenishing device of a developing apparatus in an electrophotographic image forming apparatus such as a copier are described in detail referring to the drawings, wherein like reference numerals designate identical or corresponding parts throughout the several views.

FIG. 1 is a schematic view of an image forming section of a copier according to an embodiment of the present invention. Arranged around a drum-shaped photoreceptor 1 serving as an image bearing member are a charging device (not shown) which uniformly charges the surface of the photoreceptor 1, an imaging optical system (not shown) which forms an electrostatic latent image on the surface of the photoreceptor 1 by imaging an image of an original document, a developing apparatus 30 which develops the electrostatic latent image on the surface of the photoreceptor 1 with toner, a transfer device (not shown) which transfers the toner image on the photoreceptor 1 to a recording medium such as a transfer sheet, and a cleaning device (not shown) which removes a toner remaining on the photoreceptor 1 after the toner image is transferred to the recording medium.

The developing apparatus 30 includes a developing device 2, and a toner replenishing device 10 which replenishes the developing device 2 with toner. Operations of the copier are performed by a known electrophotographic image forming process, and the description of the electrophotographic image forming process is omitted here.

The developing device 2 uses a two-component developer including toner and carrier. A developer 7 including a mixture of toner and carrier is contained in a casing 6 of the developing device 2.

Arranged in the casing 6 are a developing roller 3, screws 4 and 5, and a doctor blade 8. The screws 4 and 5 agitate and mix toner (T), which is replenished from the toner replenishing device 10 to the developing device 2 through a toner receiving section 19 of the toner replenishing device 10, with the developer 7 in the casing 6, and supply the developer 7 to the developing roller 3. The doctor blade 8 regulates the developer 7 passing through a gap between the edge of the doctor blade 8 and the periphery of the developing roller 3.

The screws 4 and 5 extend in parallel with each other in a direction perpendicular to the sheet of FIG. 1. The screws 4 and 5 are driven by a driving system (not shown) to rotate in opposite directions.

A partition plate 9 is provided between the screws 4 and 5. With the partition plate 9, developer containing sections for containing the developer 7 are provided around the screws 4 and 5, respectively. The partition plate 9 is not provided at areas around respective both end portions of the screws 4 and 5 (i.e., respective front and rear end portions of the screws 4 and 5 in a direction perpendicular to the sheet of FIG. 1), and thereby two developer containing sections communicate each other at the areas around the respective both end portions of the screws 4 and 5.

The toner (T) replenished from the toner replenishing device 10 into the developing device 2 is conveyed to the developing roller 3 while being agitated and mixed with the developer 7 by rotating the screws 4 and 5. Subsequently, with the rotations of the developing roller 3, the toner (T) of the developer 7 carried on the surface of the developing roller 3 is applied to the latent image formed on the surface of the photoreceptor 1, and thereby the toner image is formed.

Hereinafter, the construction and operations of the toner replenishing device 10 will be described.

Figure 2:
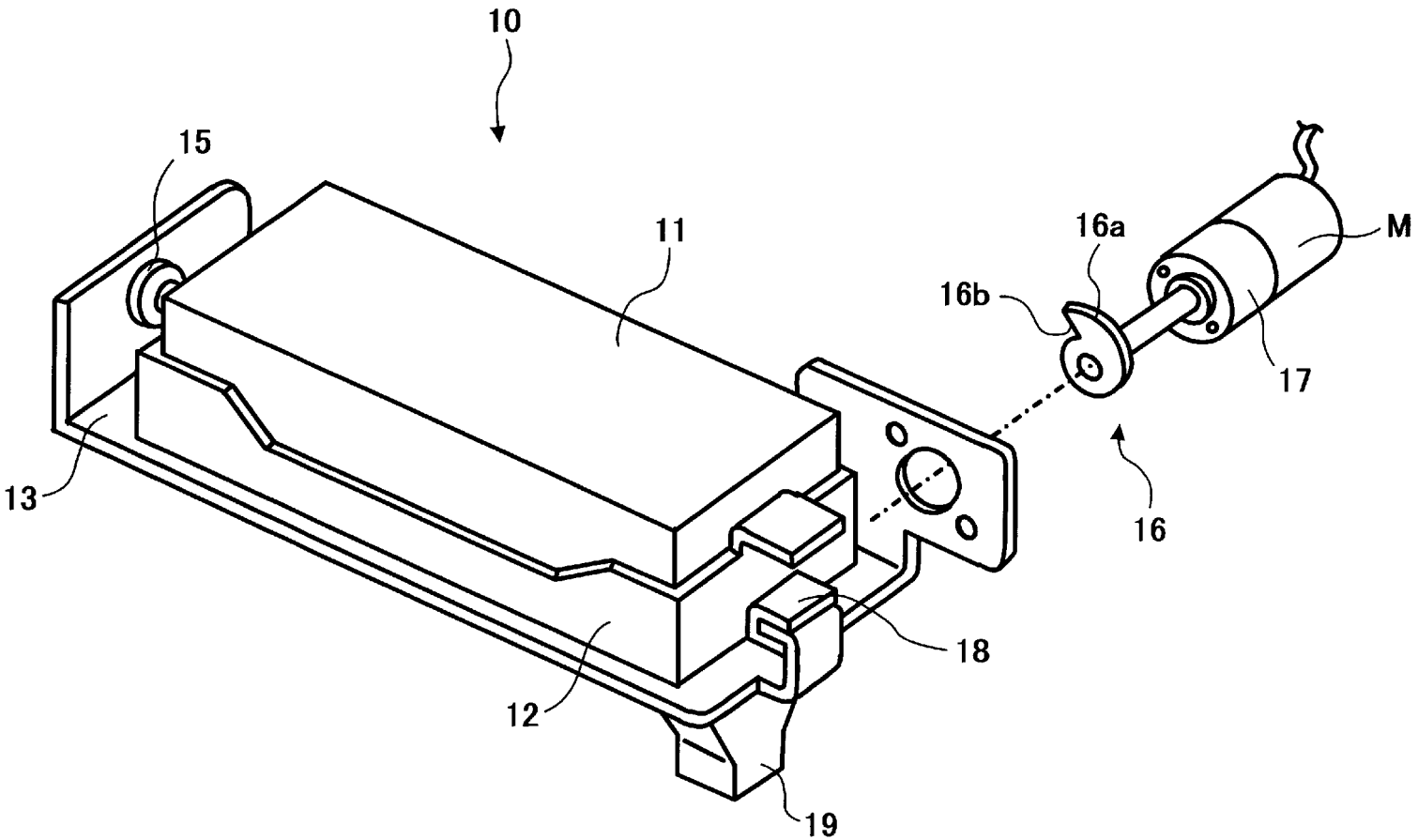
FIG. 2 is a perspective view of a schematic construction of a toner replenishing device according to the embodiment of the present invention.

FIG. 2 is a perspective view of a schematic construction of the toner replenishing device 10. As illustrated in FIGS. 1 and 2, the toner replenishing device 10 includes a toner container 11, a container holding member 12, and a support base 13. The toner container 11 is, for example, in a rectangular parallelepiped shape. As illustrated in FIG. 1, a toner discharging outlet (11*a*) is formed with the toner container 11 at one end portion of one side wall (i.e., a bottom surface) (11*c*) of the toner container 11 such that the toner discharging outlet (11*a*) protrudes outward from the toner container 11. When the toner (T) in the toner container 11 is consumed, the toner container 11 is replaced with new one filled with the toner (T). The shape of the toner container 11 is not limited to a rectangular parallelepiped but any other shapes, for example, a cylindrical shape may be employed.

The support base 13 is substantially horizontally fixed to a side plate (not shown) of the developing apparatus 30. The container holding member 12 is configured to be detachable from the support base 13. Further, the toner container 11 is configured to be detachable from the container holding member 12 and the support base 13.

When the new toner container 11 is attached to the toner replenishing device 10, first, the toner container 11 is integrally attached to the container holding member 12 taken out from the toner replenishing device 10 in advance. Specifically, the toner container 11 is integrally attached to the container holding member 12 by passing the toner discharging outlet (11*a*) of the toner container 11 through an opening (12*a*) formed in the container holding member 12.

Subsequently, the toner container 11 integrated with the container holding member 12 is attached on the support base 13 via rollers (14*a* and 14*b*) such that the toner discharging outlet (11*a*) of the toner container 11 passes through an opening (13*a*) formed in the support base 13.

With the above-described attachment of the toner container 11 to the toner replenishing device 10, the toner container 11 is disposed in a state that the toner discharging outlet (11*a*) is directed downward in substantially a vertical direction.

Further, the opening (12*a*) of the container holding member 12 is shaped such that the movement of the toner discharging outlet (11*a*) of the toner container 11 is regulated in the opening (12*a*). Moreover, the opening (13*a*) of the support base 13 is shaped such that the toner discharging outlet (11*a*) of the toner container 11 is allowed to move in the directions indicated by double-headed arrow (A) of FIG. 1 in the opening (13*a*). In the toner replenishing device 10 thus constructed, the toner container 11 is configured to move on the support base 13 together with the container holding member 12 in the directions indicated by double-headed arrow (A).

Hereinafter is described a reciprocating motion device that reciprocates the toner container 11 so as to move the toner (T) in the toner container 11 toward the toner discharging outlet (11*a*) in the toner replenishing device 10.

The reciprocating motion device includes a spring 15 serving as a biasing device, a cam 16, and a damper 18. The spring 15 is fixed to the support base 13 to bias the toner container 11 and the container holding member 12 rightward in FIG. 1. The cam 16 is rotatably provided such that the circumferential surface of the cam 16 abuts an end portion of the container holding member 12 opposite to an end portion of the container holding member 12 which the spring 15 abuts. The damper 18 is made of elastic rubber and is fixed to an end portion of the support base 13.

The cam 16 is driven to rotate at a predetermined number of revolutions by a motor (M) and a speed decreasing device 17 (illustrated in FIG. 2) fixed to the support base 13. Further, the cam 16 includes an eccentric cam surface (16*a*) and a stepped part (16*b*) as illustrated in FIGS. 1 and 2. As described later, with rotation of the cam 16 in a direction indicated by the arrow (B) in FIG. 1, the cam 16 presses the end portion of the container holding member 12 leftward in FIG. 1 against a bias force of the spring 15, and moves the toner container 11 and the container holding member 12 leftward. The cam 16 is also configured to release a pressure to the container holding member 12.

Further, the support base 13 and the damper 18 construct a stopper that stops the toner container 11 and the container holding member 12 which move rightward in FIG. 1.

Referring to FIG. 1, when the cam 16 is driven by the motor (M) to rotate in the direction indicated by the arrow (B) in FIG. 1, the eccentric cam surface (16*a*) of the cam 16 contacts and presses the end portion of the container holding member 12 against the bias force of the spring 15. With the pressure by the eccentric cam surface (16*a*) of the cam 16 to the end portion of the container holding member 12, the toner container 11 and the container holding member 12 move leftward in FIG. 1.

When the cam 16 further rotates and the end portion of the container holding member 12 goes to the stepped part (16*b*), the pressure by the eccentric cam surface (16*a*) to the container holding member 12 is released, and then the toner container 11 and the container holding member 12 move rightward in FIG. 1 by the bias force of the spring 15 with an acceleration in the rightward direction. Thus, the toner container 11 and the container holding member 12 are configured to perform a reciprocating motion in the directions indicated by the double-headed arrow (A) in FIG. 1 by one rotation of the cam 16.

The toner container 11 and the container holding member 12 which move rightward in FIG. 1 with the acceleration in the rightward direction, hit the damper 18 fixed to the end portion of the support base 13. Then, the toner container 11 and the container holding member 12 stop after residual vibration.

Because a relatively great acceleration of the toner container 11 in the leftward direction is produced when the toner container 11 and the container holding member 12 stop moving in the rightward direction, the toner (T) contained in the toner container 11 moves rightward, i.e., toward the toner discharging outlet (11*a*) by the inertial force of the toner (T) in the rightward direction.

By repeating the above-described reciprocating motions of the toner container 11 and the container holding member 12, the toner (T) contained in the substantially horizontally provided toner container 11, is gradually moved toward the toner discharging outlet (11*a*).

The toner (T) moved to the toner discharging outlet (11*a*) falls by gravity to the developing device 2 through the toner receiving section 19.

With the provision of the above-described reciprocating motion device for the toner replenishing device 10, the toner (T) can be discharged from the toner container 11 by the above-described inertial force of the toner T. Therefore, a special structure such as spiral protrusions and grooves, and a movable member such as a screw are not necessary to be provided in the toner container 11.

Further, because the toner discharging outlet (11*a*) is directed downward in substantially a vertical direction, the toner (T) does not stack around the toner discharging outlet (11*a*), so that a blockage in the toner discharging outlet (11*a*) and a reduction in toner discharging amount due to a stacked toner (T) compressed by gravity do not occur.

In the toner replenishing device 10 thus constructed, a direction of reciprocating motion of the reciprocating motion device is set to a direction along a line connecting both end portions of the one side wall (i.e., the bottom surface) (11*c*) of the toner container 11 in the longitudinal direction. That is, a direction of the rightward motion of the toner container 11 coincides with a moving direction of the toner (T) in the toner container 11 toward the toner discharging outlet (11*a*).

Therefore, the force in the rightward direction in FIG. 1 exerted on the toner container 11 by the above-described reciprocating motion device becomes a force causing the toner (T) in the toner container 11 to move toward the toner discharging outlet (11*a*), without being dispersed in other directions. Because the toner (T) can be discharged from the toner container 11 in the minimum energy by efficiently utilizing the force exerted on the toner container 11 for discharging the toner (T) from the toner container 11, the consumption of electric power in the toner replenishing device 10 can be reduced.

Figure 3:
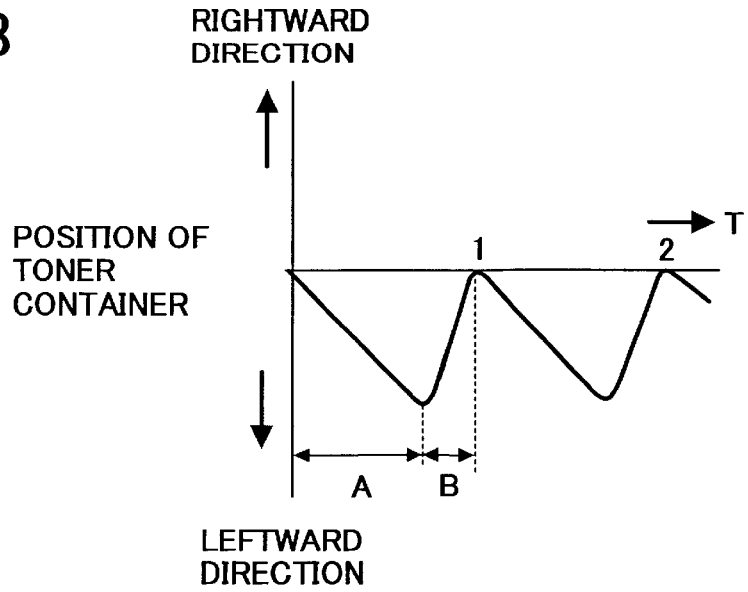
FIG. 3 is a graph illustrating a relation between a position of a toner container and a time when the toner container reciprocates.

FIG. 3 is a graph illustrating a relation between a position of the toner container 11 and the container holding member 12 and a time when the toner container 11 and the container holding member 12 reciprocate. A horizontal axis of the graph represents a time which corresponds to a number of reciprocating motions of the toner container 11 and the container holding member 12. A vertical axis of the graph represents a position of the toner container 11 and the container holding member 12 with reference to a position where the toner container 11 and the container holding member 12 hit the damper 18.

Referring to FIG. 3, the shift of the toner container 11 and the container holding member 12 in the rightward direction in FIG. 1 is illustrated in the positive, and the shift of the toner container 11 and the container holding member 12 in the leftward direction in FIG. 1 is illustrated in the negative.

In an area "A" in FIG. 3, the container holding member 12 is pressed by the eccentric cam surface (16*a*) of the cam 16, and the toner container 11 and the container holding member 12 move leftward in FIG. 1. In an area "B" in FIG. 3, the pressure by the eccentric cam surface (16*a*) of the cam 16 to the container holding member 12 is released, and the toner container 11 and the container holding member 12 move rightward in FIG. 1 by the bias force of the spring 15.

Figure 4:
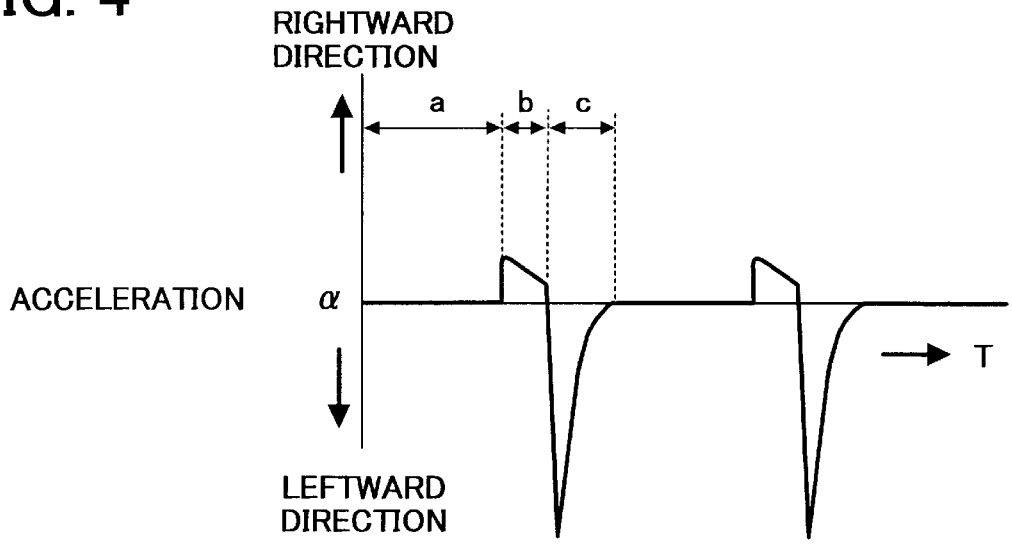
FIG. 4 is a graph illustrating a relation between an acceleration of the toner container and a time when the toner container reciprocates.

FIG. 4 is a graph illustrating a relation between an acceleration of the toner container 11 and the container holding member 12 and a time when the toner container 11 and the container holding member 12 reciprocate. A horizontal axis of the graph represents a time which corresponds to a number of reciprocating motions of the toner container 11 and the container holding member 12. A vertical axis of the graph represents an acceleration of the toner container 11 and the container holding member 12 in the rightward and leftward directions when the toner container 11 and the container holding member 12 move in the rightward and leftward, respectively.

Referring to FIG. 4, the acceleration of the toner container 11 and the container holding member 12 in the rightward direction in FIG. 1 with reference to an acceleration (a) when the toner container 11 and the container holding member 12 move under a uniform acceleration while the container holding member 12 is pressed by the eccentric cam surface (16*a*) of the cam 16, is illustrated in the positive, and the acceleration of the toner container 11 and the container holding member 12 in the leftward direction in FIG. 1 with reference to the acceleration (a) is illustrated in the negative.

In an area "a" in FIG. 4, the container holding member 12 is pressed by the eccentric cam surface (16*a*) of the cam 16, and the toner container 11 and the container holding member 12 move leftward under an uniform acceleration. In an area "b" in FIG. 4, the pressure by the eccentric cam surface (16*a*) of the cam 16 to the container holding member 12 is released, and the toner container 11 and the container holding member 12 move rightward by the bias force of the spring 15 with the acceleration in the rightward direction. In an area "c" in FIG. 4, when the toner container 11 and the container holding member 12 hit the damper 18, a relatively great acceleration in the leftward direction of the toner container 11 and the container holding member 12 is produced and then rapidly decreased.

The graphs in FIGS. 3 and 4 show that the speed and the acceleration of the toner container 11 and the container holding member 12 when the toner container 11 and the container holding member 12 move rightward is greater than those when the toner container 11 and the container holding member 12 move leftward. Further, the graph in FIG. 4 shows that when the toner container 11 and the container holding member 12 hit the damper 18, a relatively great acceleration in the leftward direction of the toner container 11 and the container holding member 12 is produced.

According to the above-described embodiment of the present invention, with the use of the rectangular parallelepiped shaped toner container 11 of a simple construction and of a low cost, the toner (T) is surely discharged from the toner container 11 and is stably replenished to the developing device 2. As a result, a latent image formed on the photoreceptor 1 is properly developed with the toner (T) by the developing device 2, and thereby a high quality image can be obtained.

Further, with the use of the toner container 11 of a simple construction and of a low cost, the total replacement cost for the toner container 11 is reduced.

Further, because the rectangular parallelepiped shaped container having plane external surfaces is employed as the toner container 11, the toner container 11 can be easily and smoothly stacked when a large number of the toner containers 11 are stored or when the toner containers 11 are transported. As compared to a cylindrical container such as a screw bottle, operability of the toner container 11 is enhanced.

Moreover, by setting the width of the side surface of the rectangular parallelepiped shaped toner container 11 to such an extent that an operator easily holds the toner container 11 with his/her hand, the failure in holding a container due to a slip of a hand in the case of the cylindrical container can be prevented.

In addition, because the rectangular parallelepiped shaped toner container 11 do not have dead space at four corners thereof, the toner containing amount of the toner container 11 is increased compared to a cylindrical container attachable to the container holding member 12.

In the above-described embodiment of the present invention, the toner container 11 may be provided such that the bottom surface of the toner container 11 inclines upwardly toward the toner discharging outlet (11*a*). In this case, the toner (T) in the toner container 11 is moved toward the toner discharging outlet (11*a*) by setting the acceleration of the toner container 11 and the container holding member 12 produced when the toner container 11 and the container holding member 12 reciprocate and hit the damper 18 so that the inertial force of the toner (T) in the rightward direction is greater than component of force of the gravity of the toner (T) exerted in the leftward direction.

Next, another embodiment in which the impulsive force produced when the toner container 11 and the container holding member 12 hit the damper 18 is reduced will be described. In this another embodiment, the toner replenishing device 10 includes an alternative construction of stopper.

Figure 5:
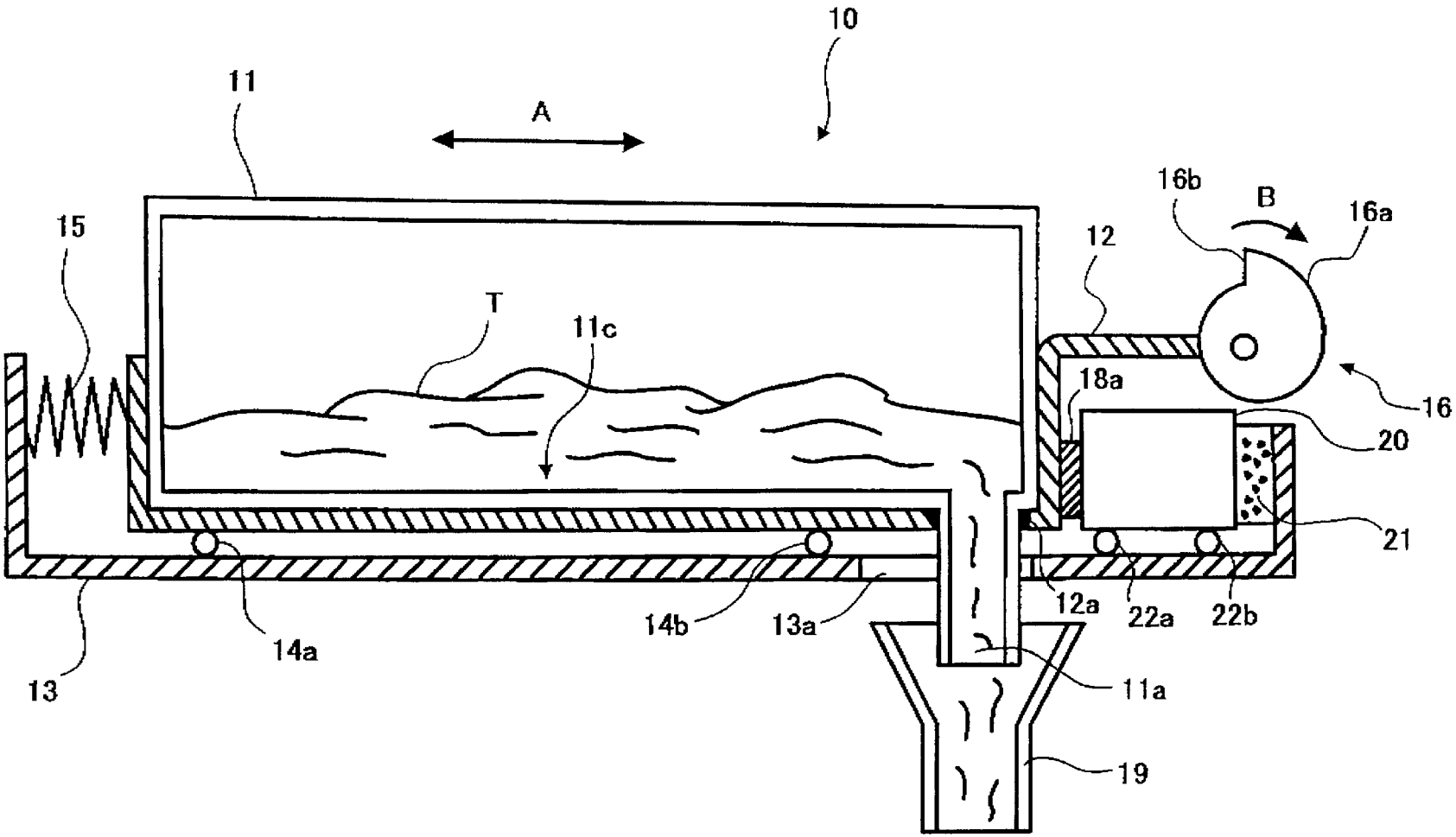
FIG. 5 is a schematic view of constructions of the toner replenishing device according to another embodiment of the present invention.
Figure 6:
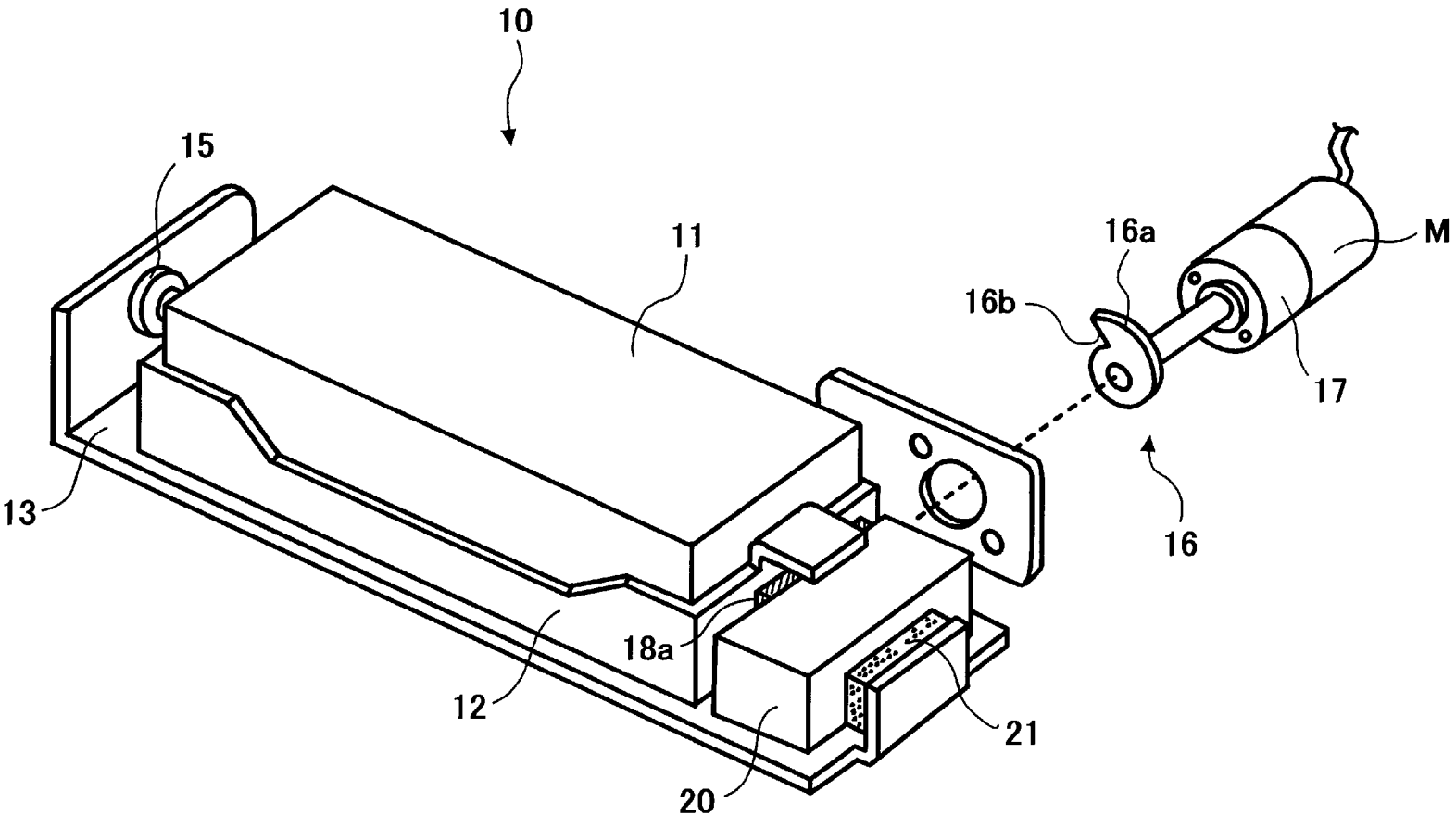
FIG. 6 is a perspective view of the toner replenishing device of FIG. 5.

FIG. 5 is a schematic view of constructions of the toner replenishing device 10 according to another embodiment of the present invention. FIG. 6 is a perspective view of the toner replenishing device 10.

In this another embodiment, a movable stopper 20 and an elastic member 21 are provided between the support base 13 and a damper (18*a*) as illustrated in FIGS. 5 and 6. The stopper 20 is configured to be moved in the rightward direction in FIG. 5 when the container holding member 12 contacts the damper (18*a*). The elastic member 21 is provided between the stopper 20 and the support base 13 so as to bias the stopper 20 in the leftward direction in FIG. 5.

As an alternative to the stopper constructed by the support base 13 and the damper 18 of the toner replenishing device 10 in FIG. 1, the support base 13, the damper (18*a*), the stopper 20, and the elastic member 21 construct a stopper of the toner replenishing device 10 in FIG. 5.

The stopper 20 is provided on the support base 13 via rollers (22*a* and 22*b*) such that the stopper 20 is movable relative to the support base 13 in substantially a horizontal position.

One end surface of the elastic member 21 is attached to the support base 13, and the other end surface of the elastic member 21 is attached to one end surface of the stopper 20. Further, the damper (18*a*) is attached to the other end surface of the stopper 20. With the above-described construction of the stopper, the elements of the stopper is so constructed as to be integrally moved by the contact of the container holding member 12 with the damper (18*a*).

Figure 7:
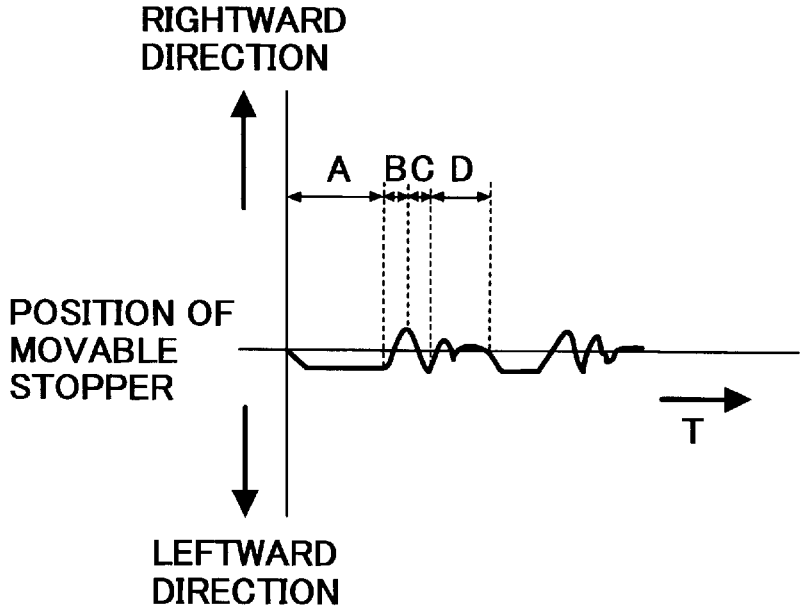
FIG. 7 is a graph illustrating a relation between a position of a stopper and a time when the toner container reciprocates.

FIG. 7 is a graph illustrating a relation between a position of the stopper 20 and a time when the toner container 11 and the container holding member 12 reciprocate. A horizontal axis of the graph represents a time. A vertical axis of the graph represents a position of the stopper 20 with reference to a position of the stopper 20 being at a standstill when the toner container 11 and the container holding member 12 do not reciprocate.

Referring to FIG. 7, the shift of the stopper 20 in the rightward direction in FIG. 5 is illustrated in the positive, and the shift of the stopper 20 in the leftward direction in FIG. 5 is illustrated in the negative. When the stopper 20 is at the standstill, the elastic member 21 is deformed by the bias force of the spring 15.

Referring to the graph in FIG. 7, the operation of the stopper in this another embodiment will be described.

In an "A" area in FIG. 7, when the toner container 11 and the container holding member 12 move leftward, the bias force of the spring 15 to the elastic member 21 is released, and the stopper 20 moves leftward by the restoring force of the deformed elastic member 21.

Then, in an area "B" in FIG. 7, when the toner container 11 and the container holding member 12 move rightward, the container holding member 12 accelerated by the bias force of the spring 15 abuts the damper (18*a*), thereby causing the damper (18*a*) and the stopper 20 to move rightward in FIG. 5. In this condition, the impact generated between the toner container 11 and the damper (18*a*) is absorbed by the stopper 20. Further, the impact secondarily transmitted through the damper (18*a*) and the stopper 20 is absorbed by the elastic member 21 owing to the elastic deformation thereof.

Owing to the impact absorption by the elastic member 21, a contact noise generated when the container holding member 12 contacts the damper (18*a*) can be reduced. In addition, vibrations caused by the contact of the container holding member 12 with the damper (18*a*) are hardly transmitted to the support base 13, and to the developing device 2 and the main body of the copier.

The impact energy absorbed by the deformed elastic member 21 is stored as an energy of the inside deformation, and then turns out to be a restoring force of the elastic member 21 when the shape of the deformed elastic member 21 is restored.

In an area "C" in FIG. 7, when the container holding member 12 is away from the damper (18*a*) by the leftward movements of the toner container 11 and the container holding member 12, the stopper 20 and the damper (18*a*) are biased in the leftward direction by the restoring force of the elastic member 21, and then move leftward.

Then, in an area "D" in FIG. 7, the stopper 20 and the damper (18*a*) come to a stop after residual vibration due to elasticity of the elastic member 21.

According to the above-described another embodiment, because the impact generated between the toner container 11 and the damper (18*a*) can be reduced, and the vibrations caused by the contact of the container holding member 12 with the damper (18*a*) are hardly transmitted to the support base 13, and to the developing device 2 and the main body of the copier, a damaging effect to an image due to vibration can be suppressed.

In order to absorb the impact generated between the toner container 11 and the damper (18*a*), the stopper 20 needs to have mass to some extent. For example, the stopper 20 is desired to include metal.

Figure 8:
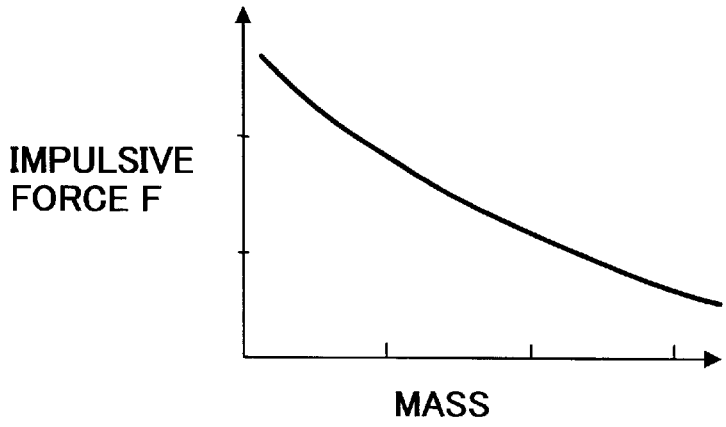
FIG. 8 is a graph showing results of an experiment to determine an impulsive force (F) transmitted to a support base when mass of the stopper is changed.

FIG. 8 is a graph showing the results of an experiment to determine an impulsive force (F) transmitted to the support base 13 when the mass of the stopper 20 is changed. The graph in FIG. 8 shows that the impulsive force (F) transmitted to the support base 13 reduces as the mass of the stopper 20 increases. According to the experiment, a preferable effect on impact absorption of the stopper 20 can be obtained when the mass of the stopper 20 is about half of the mass of the toner container 11 containing the toner (T) or greater.

The elastic member 21 may be formed from rubber, sponge, or metallic spring. However, in order to absorb the residual vibration of the stopper 20 quickly, rubber of high viscous drag, sponge, or the like are preferably employed.

Figure 9:
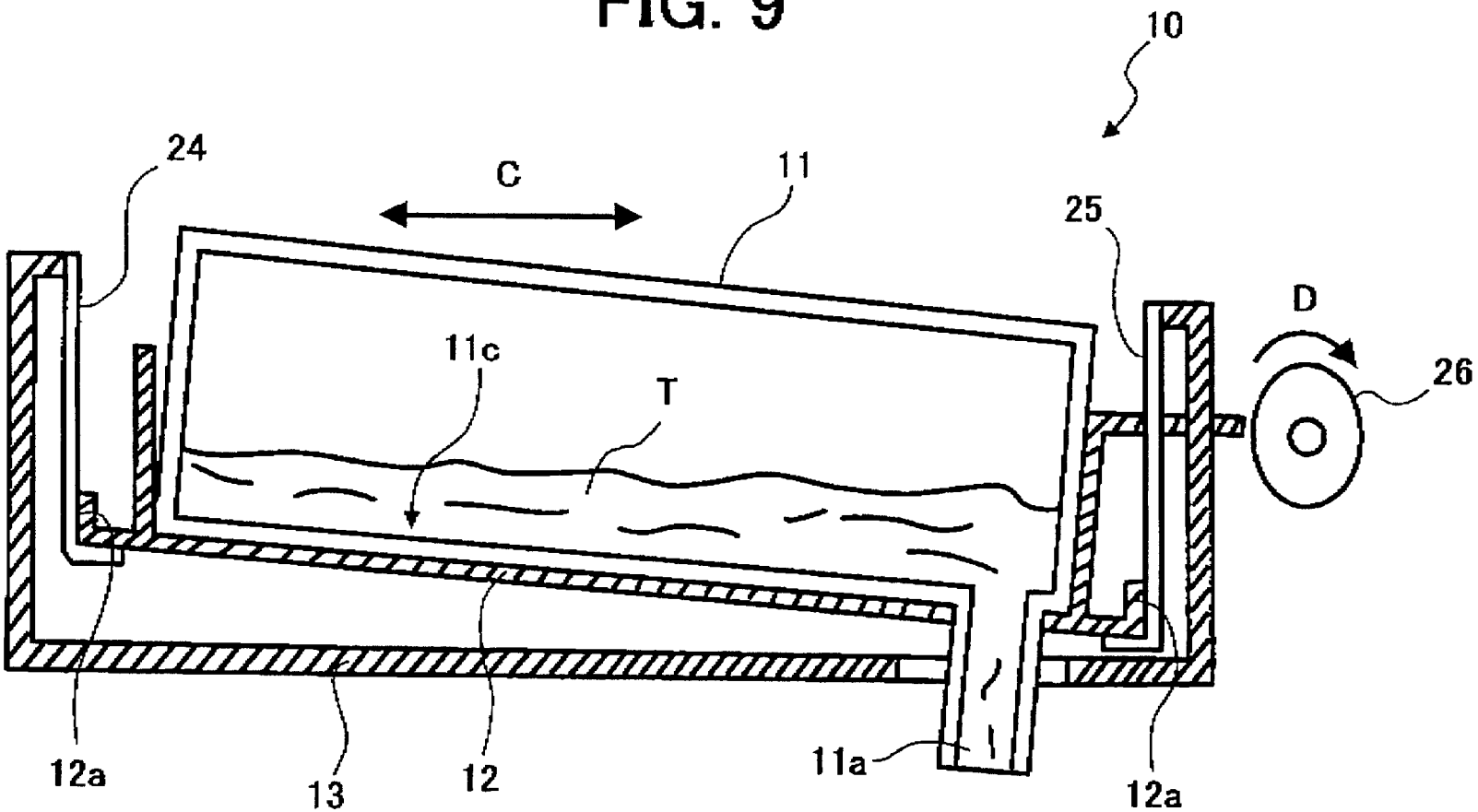
FIG. 9 is a schematic view of constructions of the toner replenishing device including an alternative reciprocating motion device according to another embodiment of the present invention.
Figure 10:
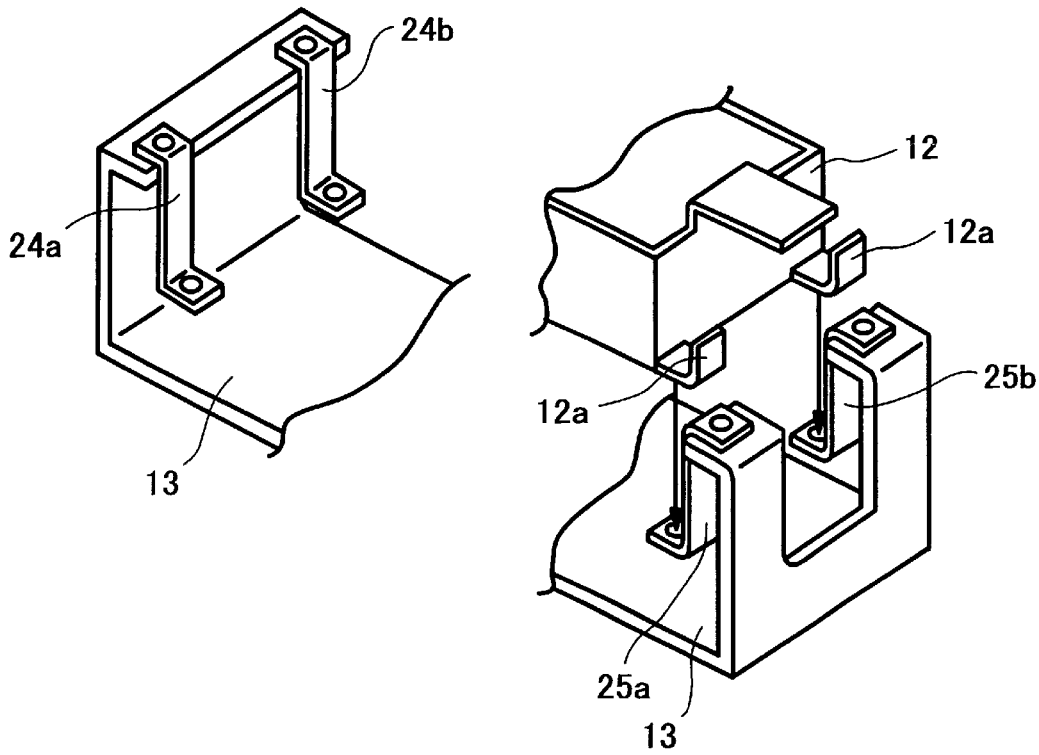
FIG. 10 is a perspective view of a part of the toner replenishing device of FIG. 9.

Next, another embodiment in which the toner replenishing device 10 of FIG. 1 includes an alternative reciprocating motion device will be described. FIG. 9 is a schematic view of constructions of the toner replenishing device 10 including an alternative reciprocating motion device according to another embodiment of the present invention. FIG. 10 is a perspective view of a part of the toner replenishing device 10.

In this another embodiment, as illustrated in FIG. 9, the toner container 11 is provided such that the bottom surface of the toner container 11 inclines downwardly toward the toner discharging outlet (11*a*). With this construction of the toner container 11, even when the toner container 11 reciprocates with substantially the same acceleration in the leftward and rightward directions, the toner (T) contained in the toner container 11 is moved toward the toner discharging outlet (11*a*).

Referring to FIGS. 9 and 10, the reciprocating motion device according to this another embodiment of the present invention includes plate springs (24*a* and 24*b*) (hereinafter may be referred to as plate springs 24 as a whole), plate springs (25*a* and 25*b*) (hereinafter may be referred to as plate springs 25 as a whole) which are longer than the plate springs (24*a* and 24*b*), and an elliptic cam 26. Respective bases of the plate springs 24 and 25 are attached to the support base 13. Further, four abutments (12*a*) provided at four comers of the bottom surface of the container holding member 12 are fixed on free ends of the plate springs 24 and 25, respectively.

With the provision of the above-described plate springs 24 and 25, the toner container 11 is disposed such that the bottom surface of the toner container 11 inclines downwardly toward the toner discharging outlet (11*a*).

The respective plate springs 24 and 25 are swingable on the bases thereof attached to the support base 13, and thereby the container holding member 12 is supported by the plate springs 24 and 25 so that the container holding member 12 swings in directions indicated by a double-headed arrow (C).

When the cam 26 is rotated in a direction indicated by the arrow (D) and when the cam 26 contacts the right side end part of the container holding member 12 in FIG. 9, the right side end part of the container holding member 12 is pushed leftward in FIG. 9 by the cam 26. Thereby, the plate springs 24 and 25 swing on the respective bases thereof attached to the support base 13.

By the swing of the plate springs 24 and 25,.the toner container 11 and the container holding member 12 substantially horizontally move leftward in FIG. 9.

When the rotation angle of the cam 26 exceeds 90°, the pressure by the cam 26 to the container holding member 12 is released, and thereby the toner container 11 and the container holding member 12 substantially horizontally move rightward in FIG. 9. Thus, every time the cam 26 rotates by half, the toner container 11 and the container holding member 12 perform a reciprocating motion in the directions indicated by the double-headed arrow (C) in FIG. 9.

Because the toner container 11 and the container holding member 12 move at a speed corresponding to the change of cam curve of the cam 26, the toner container 11 and the container holding member 12 reciprocate with substantially the same acceleration in the leftward and rightward directions.

For example, when the bottom surface of the toner container 11 is disposed in substantially a horizontal position, the inertial force of the toner (T) in the toner container 11 is substantially equal in each of leftward and rightward movements of the toner container 11 and the container holding member 12. In this condition, the toner (T) is not moved toward the toner discharging outlet (11*a*).

According to the above-described another embodiment employing the alternative reciprocating motion device, because the toner container 11 is disposed such that the bottom surface of the toner container 11 inclines downwardly toward the toner discharging outlet (11*a*), component of force of the gravity of the toner (T) is produced in a moving direction of the toner (T) toward the toner discharging outlet (11*a*). Therefore, when the toner container 11 reciprocates with substantially the same acceleration in the leftward and rightward directions, the toner (T) can be moved toward the toner discharging outlet (11*a*) by utilizing the component of force of the gravity of the toner T.

Further, according to the above-described another embodiment, because a stopper for producing relatively great acceleration of the toner container 11 in the leftward direction is not necessary to be provided in the reciprocating motion device as compared to the reciprocating motion device of the toner replenishing device 10 of FIG. 1, the construction of the toner replenishing device 10 can be simplified.

Figure 11:
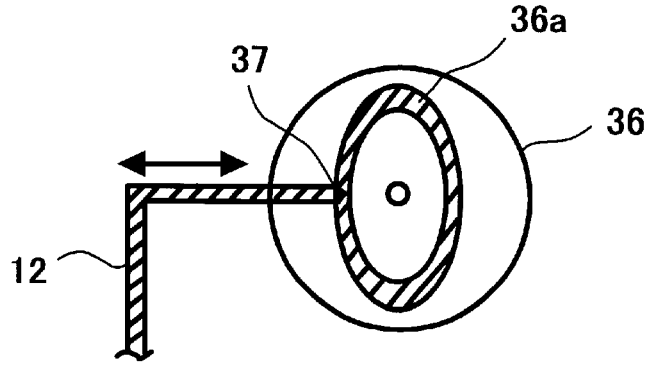
FIG. 11 is an enlarged view of a part of the toner replenishing device employing a grooved cam.

As an alternative to the above-described cam 26, a grooved cam 36, in which an elliptic groove (36*a*) is formed, may be employed as illustrated in FIG. 11. Further, a pin 37 is provided at the right side end part of the container holding member 12 to be inserted into the groove (36*a*). With the grooved cam 36 and the pin 37, because the container holding member 12 is not away from the grooved cam 36, the toner container 11 and the container holding member 12 can stably perform reciprocating motions.

Further, as an alternative to the above-described grooved cam 36, an eccentric grooved cam 46, in which a groove (46*a*) is formed eccentrically to the rotation center of the eccentric grooved cam 46, may be employed.

In this configuration with the eccentric grooved cam 46, the container holding member 12 moves at a speed corresponding to the change of cam curve of the eccentric grooved cam 46. In this condition, when the eccentric grooved cam 46 rotates in a clockwise direction, the container holding member 12 rapidly moves leftward in FIG. 9 while the pin 37 is.positioned in an area indicated by a double-headed arrow (α) in FIG. 12, and the container holding member 12 relatively slowly moves rightward in FIG. 9 while the pin 37 is positioned in an area indicated by a double-headed arrow (β) in FIG. 12.

Specifically, in this configuration, the acceleration of the toner container 11 in the leftward direction when the toner container 11 moves in the leftward direction is greater than the acceleration of the toner container 11 in the rightward direction when the toner container 11 moves in the rightward direction. As a result, the inertial force of the toner (T) in the toner container 11 in the rightward direction caused by the acceleration of the toner container 11 in the leftward direction becomes greater than the inertial force of the toner (T) in the leftward direction caused by the acceleration of the toner container 11 in the rightward direction. Therefore, the toner (T) can be moved toward the toner discharging outlet (11*a*) by utilizing the difference between the inertial forces of the toner (T) in the rightward and leftward directions.

According to the above-described embodiment employing the alternative reciprocating motion device, the toner (T) in the toner container 11 can be surely moved toward the toner discharging outlet (11*a*) owing to a synergistic effect of relatively great inertial force of the toner (T) in the rightward direction and the gravity.

In a case of utilizing the difference between the inertial forces of the toner (T) in the rightward and leftward directions, it is not necessary to incline the bottom surface of the toner container 11 as illustrated in FIG. 9, and the bottom surface of the toner container 11 can be provided in substantially a horizontal position.

Next, another embodiment of the present invention in which a powder replenishing device of the present invention is applied to a carrier replenishing device of a developing apparatus in a copier will be described. Because the structure and operation of the copier are similar to the copier in the above-described embodiments, their descriptions are omitted here.

Generally, in a developing apparatus using a two-component developer including a mixture of toner and carrier, only toner is consumed in a developing process, and carrier is repeatedly used. Because carrier deteriorates with use, the deteriorated carrier needs to be replaced with new carrier.

Figure 13:
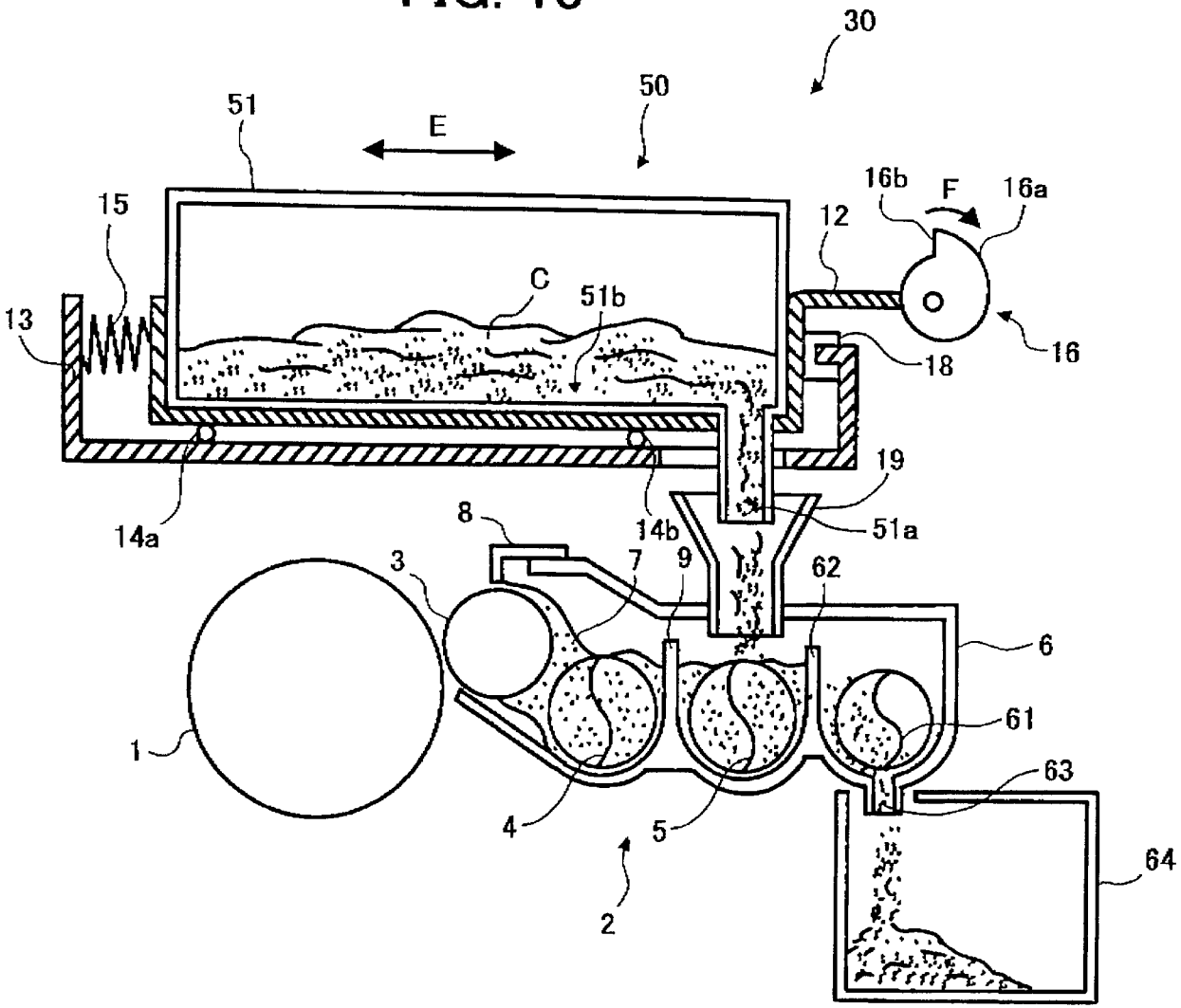
FIG. 13 is a schematic view of an image forming section of a copier according to another embodiment of the present invention.

FIG. 13 is a schematic view of an image forming section of a copier according to another embodiment of the present invention. The developing apparatus 30 includes a carrier replenishing device 50 that replenishes the developing device 2 with new carrier (C) according to the deterioration of carrier, and a developer discharging device that discharges developer including deteriorated carrier from the developing device 2.

In the developing apparatus 30 of FIG. 13, elements of the developing apparatus 30 having substantially the same functions as those employed in the developing apparatus 30 of FIG. 1 are designated with the same reference numerals and their descriptions are omitted.

Although it is not shown in FIG. 13, the toner replenishing device 10 illustrated in FIG. 1 is also provided to the developing apparatus 30 of FIG. 13 to replenish the toner to the developing device 2.

Hereinafter, the construction and operations of the carrier replenishing device 50 will be described.

As illustrated in FIG. 13, the carrier replenishing device 50 includes a rectangular parallelepiped shaped carrier container 51 in which a carrier discharging outlet (51*a*) is formed at one end portion of one side wall (i.e., a bottom surface) (51*b*) of the carrier container 51. Specifically, the carrier container 51 is disposed on the container holding member 12 and the support base 13 such that the carrier discharging outlet (51*a*) protrudes outward from the carrier container 51 and is directed downward in substantially a vertical direction.

Like the toner replenishing device 10 of FIG. 1, the carrier replenishing device 50 includes a reciprocating motion device that reciprocates the carrier container 51 so as to move the carrier (C) in the carrier container 51 toward the carrier discharging outlet (51*a*).

Similarly as in the toner replenishing device 10 of FIG. 1, the carrier (C) in the carrier container 51 can be moved rightward in FIG. 13, i.e., toward the carrier discharging outlet (51*a*) by the inertial force of the carrier (C) in the rightward direction in FIG. 13. Then, the new carrier (C) is replenished to the developing device 2.

Next, a developer discharging device according to this embodiment will be described.

Referring to FIG. 13, in the casing 6 of the developing device 2, a screw 61 for conveying and discharging the developer is arranged adjacently to the screw 5. Between the screws 5 and 61, a partition plate 62 extending in a direction perpendicular to the sheet of FIG. 13 is provided. In the partition plate 62, a part of the partition plate 62 is lower than the other part thereof.

In the developer discharging device, when the new carrier (C) is replenished from the carrier container 51 to the developing device 2 according to the deterioration of the carrier (C), the bulk of the developer 7 in the developer containing section around the screw 5 increases, and the increased developer 7 passes over the partition plate 62 and moves toward the screw 61.

Further, the developer 7 passed over the partition plate 62 is conveyed toward the front side as viewed in FIG. 13 by the screw 61, and is then discharged from the developing device 2 through a developer discharging outlet 63 protruded outward from the casing 6 and directed downward in substantially a vertical direction.

The developer 7 discharged from the developing device 2 is collected to a developer collecting container 64 provided under the developer discharging outlet 63.

If each of volumetric capacity of the carrier container 51 and the developer collecting container 64 is set to be substantially equal, the developer collecting container 64 becomes full when all the carrier (C) in the carrier container 51 is replenished to the developing device 2. In such a case, the carrier container 51 and the developer collecting container 64 can be replaced at the same time, so that the replacement of the carrier container 51 and the developer collecting container 64 can be done efficiently.

As an alternative to the carrier (C), a developer in which carrier and toner are mixed at a proper ratio may be replenished to the developing device 2.

With the above-described carrier replenishing device 50 and the developer discharging device, the new carrier (C) is replenished to the developing device 2 according to the deterioration of carrier, and the developer 7 including the deteriorated carrier is discharged from the developing device 2. Thereby, the lowering of the development ability of the developing device 2 due to deterioration of carrier is prevented. As a result, a good quality image can be obtained.

In the carrier replenishing device 50, similar effects as in the toner replenishing device 10 of FIG. 1 can be obtained.

Moreover, the above-described alternative construction of stopper and alternative reciprocating motion device for the toner replenishing device 10 can be also employed in the carrier replenishing device 50.

Next, another embodiment of the present invention in which a powder conveying device of the present invention is applied to a developing apparatus of a copier will be described.

Because the structure and operation of the copier are similar to the copier in the above-described embodiments, their descriptions are omitted here.

Figure 14:
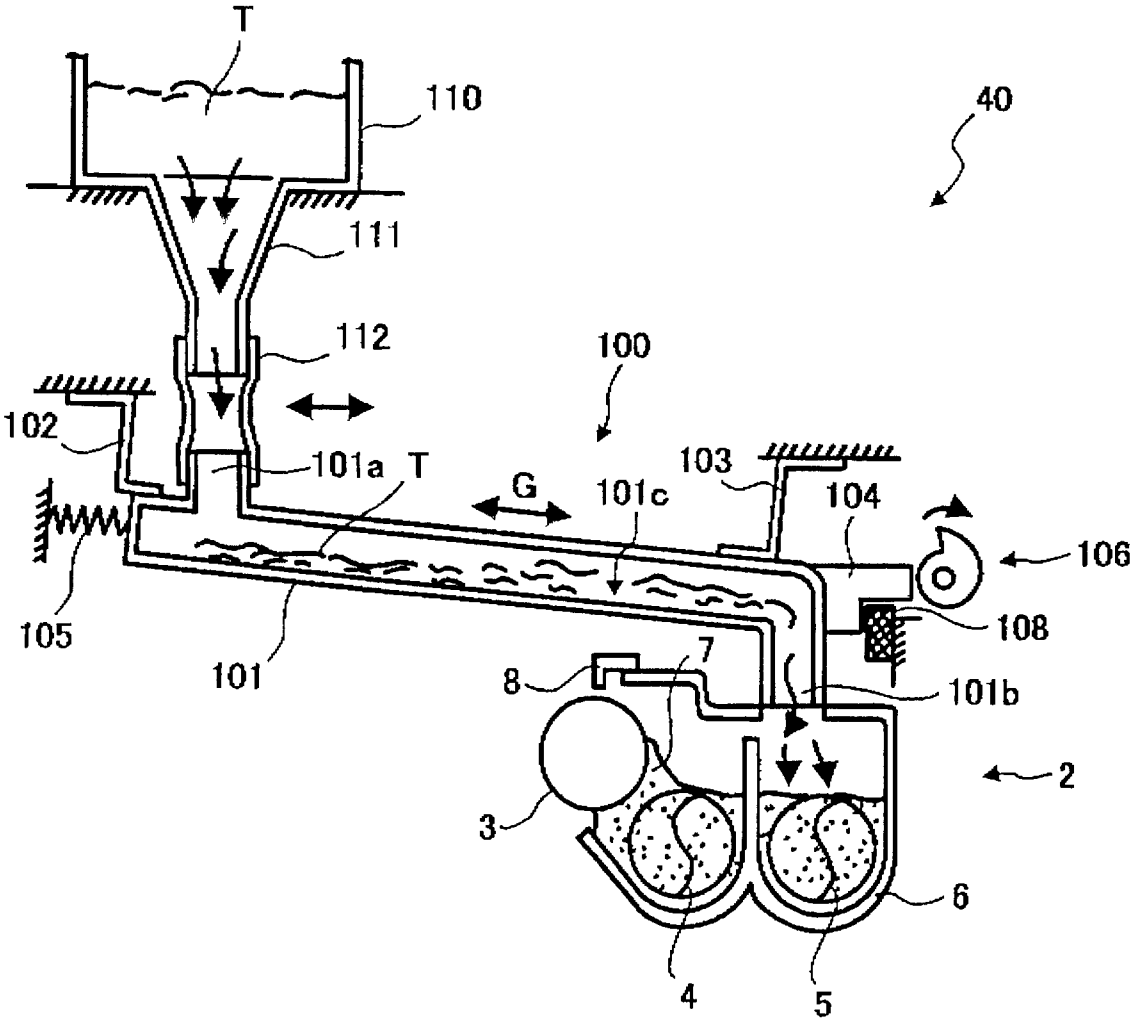
FIG. 14 is a schematic view of a part of a developing apparatus according to another embodiment of the present invention.
Figure 15:
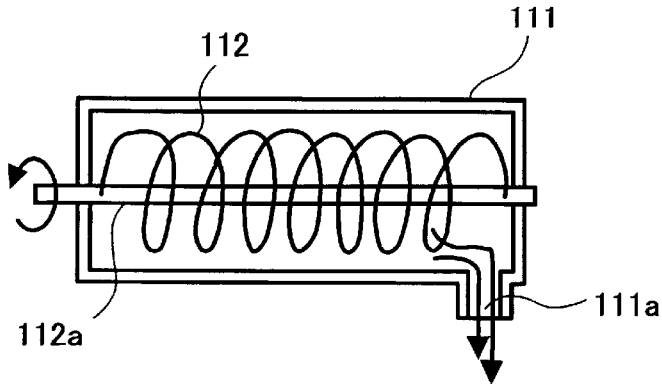
FIG. 15 BACKGROUND ART
FIG. 15 is a view of a toner container according to a background art.
Figure 16:
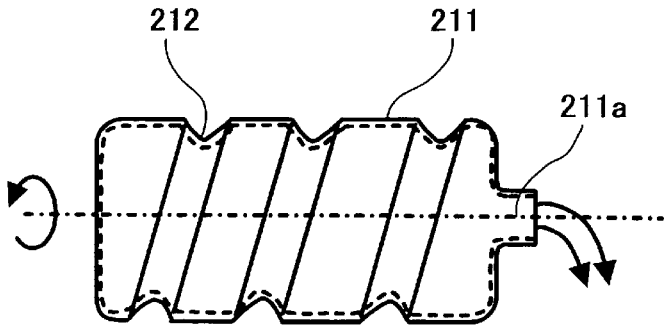
FIG. 16 BACKGROUND ART
FIG. 16 is a view of a screw bottle according to a background art.
Figure 17:
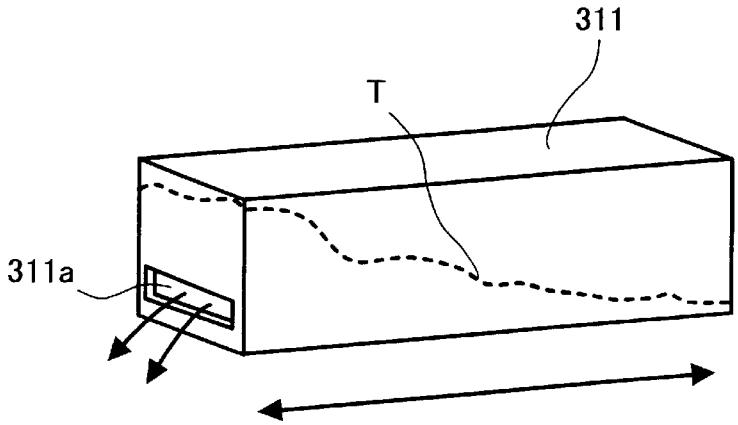
FIG. 17 BACKGROUND ART
FIG. 17 is a view of a toner replenishing device developed by the inventors.

FIG. 14 is a schematic view of a part of a developing apparatus 40 according to another embodiment of the present invention. In the developing apparatus 40 of FIG. 14, elements of the developing apparatus 40 having substantially the same functions as those employed in the developing apparatus 30 of FIG. 1 are designated with the same reference numerals and their descriptions are omitted.

Referring to FIG. 14, the developing apparatus 40 includes a toner container 110 that contains toner (T), a toner receiving section 111 that receives the toner (T) from the toner container 110, and a toner conveying device 100 that conveys the toner (T) from the toner receiving section 111 to the developing device 2.

The toner conveying device 100 includes, for example, a cylindrical pipe 101 as a toner conveying path member forming a toner conveying path. The pipe 101 includes an inlet (101*a*) communicating to the toner receiving section 111, and an outlet (101*b*) communicating to the developing device 2. The toner receiving section 111 connects to the inlet (101*a*) of the pipe 101 via a tube 112, thereby allowing the pipe 101 to reciprocate.

The shape of the cross section of the pipe 101 in a direction perpendicular to the toner conveying direction is not limited to a circle, but a rectangular cross-section pipe 101 can be employed.

The toner conveying device 100 further includes a reciprocating motion device that reciprocates the pipe 101 in directions indicated by double-headed arrow (G) in FIG. 14.

In this embodiment, as illustrated in FIG. 14, the reciprocating motion device includes a plate spring 102 and a plate spring 103 which is longer than the plate spring 102. Respective bases of the plate springs 102 and 103 are attached to an inner wall of the main body of the copier. Further, the pipe 101 is fixed to each of free ends of the plate springs 102 and 103.

With the provision of the above-described plate springs 102 and 103, the pipe 101 is provided such that one side wall (101*c*) of the pipe 101 (hereinafter referred to as a bottom surface) inclines downwardly toward the outlet (101*b*) of the pipe 101.

Each of plate springs 102 and 103 is swingable on the base attached to the inner wall of the main body of the copier, and thereby the pipe 101 is supported by the plate springs 102 and 103 such that the pipe 101 swings in the directions indicated by double-headed arrow (G).

The reciprocating motion device of the toner conveying device 100 includes a spring 105 serving as a bias device, a cam 106, and a damper 108. The spring 105 abuts one end portion of the pipe 101 to bias the pipe 101 rightward in FIG. 14. The cam 106 is rotatably provided such that the circumferential surface of the cam 106 contacts an end surface of a contact member 104 provided on another end portion of the pipe 101 opposite to the one end portion of the pipe 101 which the spring 105 abuts. The damper 108 is formed from elastic rubber and is fixed to a side plate of the main body of the copier to serve as a stopper. The contact member 104 is integrally formed with the pipe 101. The cam 106 has a similar construction to the cam 16 of the toner replenishing device 10 of FIG. 1.

In the above-described toner conveying device 100, every time the cam 106 rotates by one rotation, the pipe 101 performs a reciprocating motion in the directions indicated by double-headed arrow (G) in FIG. 14. Then, the pipe 101 stops moving after the pipe 101 has hit the damper 108

By the inertial force of the toner (T) in the pipe 101 in the rightward direction in FIG. 14 produced when the pipe 101 stops moving in the rightward direction and by component of force of the gravity of the toner (T) exerted in the direction from the inlet (101*a*) to the outlet (101*b*), the toner (T) in the pipe 101 is moved toward the outlet (101*b*). By repeating the above-described reciprocating motions of the pipe 101, the toner (T) in the pipe 101 is gradually conveyed toward the outlet (101*b*).

Further, by providing the pipe 101 such that the bottom surface thereof inclines downwardly toward the outlet (101*b*), frictional resistance exerted at a contact part of the pipe 101 and the toner (T) toward the outlet (101*b*) can be less than that when the bottom surface of the pipe 101 is provided in substantially a horizontal position. Therefore, as compared to a case in which the bottom surface of the pipe 101 is provided in substantially a horizontal position, the toner (T) in the pipe 101 can be easily conveyed toward the outlet (101*b*) in the toner conveying device 100. The toner (T) conveyed to the outlet (101*b*) falls to the developing device 2 by its own gravity.

According to the above-described embodiment of the present invention, the pipe 101 is provided such that the bottom surface thereof inclines downwardly toward the outlet (101*b*), and frictional resistance exerted at a contact part of the pipe 101 and the toner (T) toward the outlet (101*b*) is made less than that when the bottom surface of the pipe 101 is disposed in substantially a horizontal position. With this construction of the toner conveying device 100, even when the cross-sectional area of the pipe 101 is small, the toner (T) can be properly conveyed.

Thus, the size of the toner conveying device 100 can be reduced by making the cross-sectional area of the pipe 101 small, and the toner (T) can be properly conveyed. Further, because the toner (T) conveyed smoothly in the pipe 101 is stably replenished to the developing device 2, a proper developing operation can be performed in the developing device 2, and thereby a good quality image can be obtained.

In the above-described toner conveying device 100, the direction of reciprocating motion of the pipe 101 is along a line connecting the one end portion and the opposite another end portion of the bottom surface of the pipe 101. That is, the moving direction of the pipe 101 in the leftward direction coincides with the moving direction of the toner (T) in the pipe 101 toward the outlet (101*b*). Therefore, similarly as in the toner replenishing device 10 of FIG. 1, the toner (T) can be conveyed in the pipe 101 in the minimum energy. As a result, the consumption of electric power in the toner conveying device 100 can be reduced.

In order to reduce an impulsive force produced when the contact member 104 integrally formed with the pipe 101 hits the damper 108, the aforementioned alternative construction of the stopper illustrated in FIGS. 5 and 6 may be also employed in the toner conveying device 100.

Figure 12:
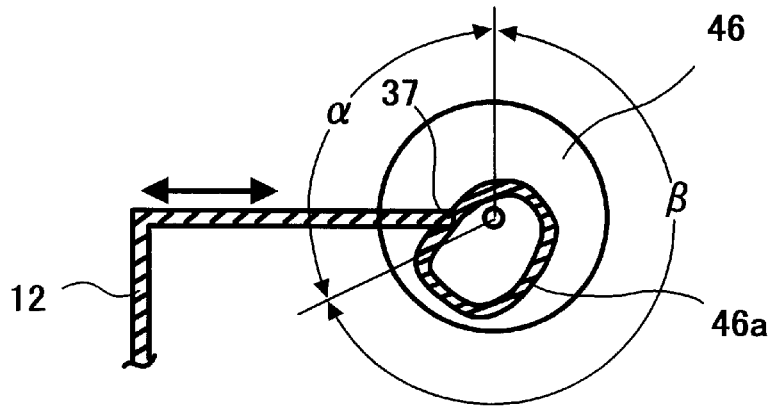
FIG. 12 is an enlarged view of a part of the toner replenishing device employing an eccentric grooved cam.

Further, as an alternative to the cam 106, the elliptic cam 26 illustrated in FIG. 9, the grooved cam 36 illustrated in FIG. 11, or the eccentric grooved cam 46 illustrated in FIG. 12 may be employed.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-230582 filed in the Japanese Patent Office on Jul. 31, 2000, and the entire contents of which are hereby incorporated by reference.

What is claimed as new and is desired to be secured by Letters Patent of the United States is:

1. A powder replenishing device, comprising:

a powder container configured to contain powder and including a powder discharging outlet at one end portion of one side wall of the powder container; and a reciprocating motion device configured to substantially linearly reciprocate the powder container between forward and backward directions with respect to a moving direction of the powder toward the powder discharging outlet so as to move the powder in the powder container toward the powder discharging outlet in a state that the powder discharging outlet is directed downward in substantially a vertical direction.

2. The powder replenishing device according to claim 1, wherein a direction of reciprocating motion of the reciprocating motion device is set to a direction along a line connecting the one end portion and an opposite another end portion of the one side wall of the powder container.

3. The powder replenishing device according to claim 1, wherein the powder container is provided such that the one side wall of the powder container inclines downwardly toward the powder discharging outlet.

4. The powder replenishing device according to claim 1, wherein an acceleration of the powder container in the forward direction when the powder container moves in the forward direction is set to be greater than an acceleration of the powder container in the backward direction when the powder container moves in the backward direction.

5. The powder replenishing device according to claim 1, wherein an acceleration of the powder container in the backward direction produced when the powder container stops moving in the forward direction is set to be greater than an acceleration of the powder container in the forward direction when the powder container stops moving in the backward direction.

6. The powder replenishing device according to claim 5, further comprising:

a biasing device configured to bias the powder container in the forward direction by a bias force thereof;

a pressing device configured to press and move the powder container in the backward direction against the bias force of the biasing device;

a pressure release device configured to release the pressing device pressing the powder container to the backward direction; and a stopper configured to contact and stop the powder container which moves in the forward direction by the bias force of the biasing device after the pressure release device has released the pressing device.

7. The powder replenishing device according to claim 6, further comprising a support base configured to support the powder container, wherein the stopper is configured to be moved in the forward direction when the powder container contacts the stopper, and wherein an elastic member is provided between the stopper and the support base so as to bias the stopper in the backward direction.

8. The powder replenishing device according to claim 1, wherein the powder container has a rectangular parallelepiped shape.

9. The powder replenishing device according to claim 1, wherein the powder container is detachable from the powder replenishing device.

10. A developing apparatus that develops a latent image formed on an image bearing member with developer, comprising:

a developing device configured to apply the developer to the latent image on the image bearing member; and a developer replenishing device configured to replenish the developing device with developer, the developer replenishing device including, a developer container configured to contain developer and including a developer discharging outlet at one end portion of one side wall of the developer container; and a reciprocating motion device configured to substantially linearly reciprocate the developer container between forward and backward directions with respect to a moving direction of the developer toward the developer discharging outlet so as to move the developer in the developer container toward the developer discharging outlet in a state that the developer discharging outlet is directed downward in substantially a vertical direction.

11. The developing apparatus according to claim 10, wherein a direction of reciprocating motion of the reciprocating motion device is set to a direction along a line connecting the one end portion and an opposite another end portion of the one side wall of the developer container.

12. The developing apparatus according to claim 10, wherein the developer container is provided such that the one side wall of the developer container inclines downwardly toward the developer discharging outlet.

13. The developing apparatus according to claim 10, wherein an acceleration of the developer container in the forward direction when the developer container moves in the forward direction is set to be greater than an acceleration of the developer container in the backward direction when the developer container moves in the backward direction of the developer toward the developer discharging outlet.

14. The developing apparatus according to claim 10, wherein an acceleration of the developer container in the backward direction produced when the developer container stops moving in the forward direction is set to be greater than an acceleration of the developer container in the forward direction when the developer container stops moving in the backward direction.

15. The developing apparatus according to claim 14, further comprising:

a biasing device configured to bias the developer container in the forward direction by a bias force thereof;

a pressing device configured to press and move the developer container in the backward direction against the bias force of the biasing device;

a pressure release device configured to release the pressing device pressing the developer container to the backward direction; and a stopper configured to contact and stop the developer container which moves in the forward direction by the bias force of the biasing device after the pressure release device has released the pressing device.

16. The developing apparatus according to claim 15, further comprising a support base configured to support the developer container, wherein the stopper is configured to be moved in the forward direction when the developer container contacts the stopper, and wherein an elastic member is provided between the stopper and the support base so as to bias the stopper in the backward direction.

17. The developing apparatus according to claim 10, wherein the developer container has a rectangular parallelepiped shape.

18. The developing apparatus according to claim 10, wherein the developer container is detachable from the developer replenishing device.

19. An image forming apparatus, comprising:

an image bearing member configured to bear a latent image;

a developing device configured to develop the latent image formed on the image bearing member with developer; and a developer replenishing device configured to replenish the developing device with developer, the developer replenishing device including, a developer container configured to contain developer and including a developer discharging outlet at one end portion of one side wall of the developer container; and a reciprocating motion device configured to substantially linearly reciprocate the developer container between forward and backward directions with respect to a moving direction of the developer toward the developer discharging outlet so as to move the developer in the developer container toward the developer discharging outlet in a state that the developer discharging outlet is directed downward in substantially a vertical direction.

20. The image forming apparatus according to claim 19, wherein a direction of reciprocating motion of the reciprocating motion device is set to a direction along a line connecting the one end portion and an opposite another end portion of the one side wall of the developer container.

21. The image forming apparatus according to claim 19, wherein the developer container is provided such that the one side wall of the developer container inclines downwardly toward the developer discharging outlet.

22. The image forming apparatus, according to claim 19, wherein an acceleration of the developer container in the forward direction when the developer container moves in the forward direction is set to be greater than an acceleration of the developer container in the backward direction when the developer container moves in the backward direction of the developer toward the developer discharging outlet.

23. The image forming apparatus according to claim 19, wherein an acceleration of the developer container in the backward direction produced when the developer container stops moving in the forward direction is set to be greater than an acceleration of the developer container in the forward direction when the developer container stops moving in the backward direction.

24. The image forming apparatus according to claim 23, further comprising:

a biasing device configured to bias the developer container in the forward direction by a bias force thereof;

a pressing device configured to press and move the developer container in the backward direction against the bias force of the biasing device;

a pressure release device configured to release the pressing device pressing the developer container to the backward direction; and a stopper configured to contact and stop the developer container which moves in the forward direction by the bias force of the biasing device after the pressure release device has released the pressing device.

25. The image forming apparatus according to claim 24, further comprising a support base configured to support the developer container, wherein the stopper is configured to be moved in the forward direction when the developer container contacts the stopper, and wherein an elastic member is provided between the stopper and the support base so as to bias the stopper in the backward direction.

26. The image forming apparatus according to claim 19, wherein the developer container has a rectangular parallelepiped shape.

27. The image forming apparatus according to claim 19, wherein the developer container is detachable from the developer replenishing device.

28. A powder conveying device, comprising:

a powder conveying path member configured to convey powder therethrough, the powder conveying path member including one side wall and forming a powder conveying path having an inlet and an outlet, the outlet being directed downward in substantially a vertical direction; and a reciprocating motion device configured to substantially linearly reciprocate the powder conveying path member between forward and backward directions with respect to a moving direction of the powder toward the outlet so as to move the powder in the powder conveying path member toward the outlet, wherein the powder conveying path member is provided such that the one side wall inclines downwardly toward the outlet.

29. The powder conveying device according to claim 28, wherein a direction of reciprocating motion of the reciprocating motion device is set to a direction along a line connecting one end portion and an opposite another end portion of the one side wall of the powder conveying path member.

30. The powder conveying device according to claim 28, wherein an acceleration of the powder conveying path member in the forward direction when the powder conveying path member moves in the forward direction is set to be greater than an acceleration of the powder conveying path member in the backward direction when the powder conveying path member moves in the backward direction.

31. The powder conveying device according to claim 28, wherein an acceleration of the powder conveying path member in the backward direction produced when the powder conveying path member stops moving in the forward direction is set to be greater than an acceleration of the powder conveying path member in the forward direction when the powder conveying path member stops moving in the backward direction.

32. The powder conveying device according to claim 31, further comprising:

a biasing device configured to bias the powder conveying path member in the forward direction by a bias force thereof;

a pressing device configured to press and move the powder conveying path member in the backward direction against the bias force of the biasing device;

a pressure release device configured to release the pressing device pressing the powder conveying path member to the backward direction; and a stopper configured to contact and stop the powder conveying path member which moves in the forward direction by the bias force of the biasing device after the pressure release device has released the pressing device.

33. The powder conveying device according to claim 32, further comprising a frame, wherein the stopper is configured to be moved in the forward direction when the powder conveying path member contacts the stopper, and wherein an elastic member is provided between the stopper and the frame so as to bias the stopper in the backward direction.

34. A developing apparatus that develops a latent image formed on an image bearing member with developer, comprising:

a developing device configured to apply the developer to the latent image on the image bearing member; and a developer conveying device configured to convey the developer to the developing device, the developer conveying device including, a developer conveying path member configured to convey developer therethrough, the developer conveying path member including one side wall and forming a developer conveying path having an inlet and an outlet, the outlet being directed downward in substantially a vertical direction; and a reciprocating motion device configured to substantially linearly reciprocate the developer conveying path member between forward and backward directions with respect to a moving direction of the developer toward the outlet so as to move the developer in the developer conveying path member toward the outlet, wherein the developer conveying path member is provided such that the one side wall inclines downwardly toward the outlet.

35. The developing apparatus according to claim 34, wherein a direction of reciprocating motion of the reciprocating motion device is set to a direction along a line connecting one end portion and an opposite another end portion of the one side wall of the developer conveying path member.

36. The developing apparatus according to claim 34, wherein an acceleration of the developer conveying path member in the forward direction when the developer conveying path member moves in the forward direction is set to be greater than an acceleration of the developer conveying path member in the backward direction when the developer conveying path member moves in the backward direction.

37. The developing apparatus according to claim 34, wherein an acceleration of the developer conveying path member in the backward direction produced when the developer conveying path member stops moving in the forward direction is set to be greater than an acceleration of the developer conveying path member in the forward direction when the developer conveying path member stops moving in the backward direction.

38. The developing apparatus according to claim 37, further comprising:

a biasing device configured to bias the developer conveying path member in the forward direction by a bias force thereof;

a pressing device configured to press and move the developer conveying path member in the backward direction against the bias force of the biasing device;

a pressure release device configured to release the pressing device pressing the developer conveying path member to the backward direction; and a stopper configured to contact and stop the developer conveying path member which moves in the forward direction by the bias force of the biasing device after the pressure release device has released the pressing device.

39. The developing apparatus according to claim 38, further comprising a frame, wherein the stopper is configured to be moved in the forward direction when the developer conveying path member contacts the stopper, and wherein an elastic member is provided between the stopper and the frame so as to bias the stopper in the backward direction.

40. An image forming apparatus, comprising:

an image beating member configured to bear a latent image;

a developer device configured to develop the latent image formed on the image bearing member with developer; and a developer conveying device configured to convey the developer to the developing device, the developer conveying device including, a developer conveying path member configured to convey developer therethrough, the developer conveying path member including one side wall and forming a developer conveying path having an inlet and an outlet, the outlet being directed downward in substantially a vertical direction; and a reciprocating motion device configured to substantially linearly reciprocate the developer conveying path member between forward and backward directions with respect to a moving direction of the developer toward the outlet so as to move the developer in the developer conveying path member toward the outlet, wherein the developer conveying path member is provided such that the one side wall inclines downwardly toward the outlet.

41. The image forming apparatus according to claim 40, wherein a direction of reciprocating motion of the reciprocating motion device is set to a direction along a line connecting one end portion and an opposite another end portion of the one side wall of the developer conveying path member.

42. The image forming apparatus according to claim 40, wherein an acceleration of the developer conveying path member in the forward direction when the developer conveying path member moves in the forward direction is set to be greater than an acceleration of the developer conveying path member in the backward direction when the developer conveying path member moves in the backward direction.

43. The image forming apparatus according to claim 40, wherein an acceleration of the developer conveying path member in the backward direction produced when the developer conveying path member stops moving in the forward direction is set to be greater than an acceleration of the developer conveying path member in the forward direction when the developer conveying path member stops moving in the backward direction.

44. The image forming apparatus according to claim 43, further comprising:

a biasing device configured to bias the developer conveying path member in the forward direction by a bias force thereof;

a pressing device configured to press and move the developer conveying path member in the backward direction against the bias force of the biasing device;

a pressure release device configured to release the pressing device pressing the developer conveying path member to the backward direction; and a stopper configured to contact and stop the developer conveying path member which moves in the forward direction by the bias force of the biasing device after the pressure release device has released the pressing device.

45. The image forming apparatus according to claim 44, further comprising a frame, wherein the stopper is configured to be moved in the forward direction when the developer conveying path member contacts the stopper, and wherein an elastic member is provided between the stopper and the frame so as to bias the stopper in the backward direction.

46. A method of replenishing powder to a developing device of an image forming apparatus, the method comprising the steps of:

containing the powder in a powder container having a powder discharging outlet; and substantially linearly reciprocating the powder container between forward and backward directions with respect to a moving direction of the powder toward the powder discharging outlet so as to move the powder in the powder container toward the powder discharging outlet.

47. The method according to claim 46, wherein in the step of reciprocating the powder container, the powder is moved downwardly in a slanting direction toward the powder discharging outlet.

48. The method according to claim 46, wherein the step of reciprocating the powder container comprises, causing an acceleration of the powder container in the forward direction when the powder container moves in the forward direction, and an acceleration of the powder container in the backward direction when the powder container moves in the backward direction; and setting the acceleration of the powder container in the forward direction when the powder container moves in the forward direction to be greater than the acceleration of the powder container in the backward direction when the powder container moves in the backward direction.

49. The method according to claim 46, wherein the step of reciprocating the powder container comprises, causing an acceleration of the powder container in the backward direction when the powder container stops moving in the forward direction, and an acceleration of the powder container in the forward direction when the powder container stops moving in the backward direction; and setting the acceleration of the powder container in the backward direction when the powder container stops moving in the forward direction to be greater than the acceleration of the powder container in the forward direction when the powder container stops moving in the backward direction.

50. The method according to claim 49, wherein the step of reciprocating the powder container comprises, biasing the powder container in the forward direction by a bias force of a biasing device;

pressing and moving the powder container in the backward direction by a pressing device against the bias force of the biasing device;

releasing the pressing device pressing the powder container in the backward direction so that the powder container stops moving in the backward direction and moves in the forward direction by the bias force of the biasing device with the acceleration in the forward direction; and stopping the powder container from moving in the forward direction so that the powder container moves in the backward direction with the acceleration in the backward direction.

51. A method of conveying powder through a powder conveying path member having an outlet to a developing device of an image forming apparatus, the method comprising the steps of:

substantially linearly reciprocating the powder conveying path member between forward and backward directions with respect to a moving direction of the powder toward the outlet so as to move the powder in the powder conveying path member toward the outlet; and falling the powder through the outlet to the developing device.

52. The method according to claim 51, wherein in the step of reciprocating the powder conveying path member, the powder is moved downwardly in a slanting direction toward the outlet.

53. The method according to claim 51, wherein the step of reciprocating the powder conveying path member comprises, causing an acceleration of the powder conveying path member in the forward direction when the powder conveying path member moves in the forward direction, and an acceleration of the powder conveying path member in the backward direction when the powder conveying path member moves in the backward direction; and setting the acceleration of the powder conveying path member in the forward direction when the powder conveying path member moves in the forward direction to be greater than the acceleration of the powder conveying path member in the backward direction when the powder conveying path member moves in the backward direction.

54. The method according to claim 51, wherein the step of reciprocating the powder conveying path member comprises, causing an acceleration of the powder conveying path member in the backward direction when the powder conveying path member stops moving in the forward direction, and an acceleration of the powder conveying path member in the forward direction when the powder conveying path member stops moving in the backward direction; and setting the acceleration of the powder conveying path member in the backward direction when the powder conveying path member stops moving in the forward direction to be greater than the acceleration of the powder conveying path member in the forward direction when the powder conveying path member stops moving in the backward direction.

55. The method according to claim 54, wherein the step of reciprocating the powder conveying path member comprises, biasing the powder conveying path member in the forward direction by a bias force of a biasing device;

pressing and moving the powder conveying path member in the backward direction by a pressing device against the bias force of the biasing device;

releasing the pressing device pressing the powder conveying path member in the backward direction so that the powder conveying path member stops moving in the backward direction and moves in the forward direction by the bias force of the biasing device with the acceleration in the forward direction; and stopping the powder conveying path member from moving in the forward direction so that the powder conveying path member moves in the backward direction with the acceleration in the backward direction.

56. A powder replenishing device, comprising:

means for containing powder, the containing means including a powder discharging outlet at one end portion of one side wall of the containing means; and means for substantially linearly reciprocating the containing means between forward and backward directions with respect to a moving direction of the containing means toward the powder discharging outlet, the reciprocating means reciprocating the containing means so as to move the powder in the containing means toward the powder discharging outlet in a state that the powder discharging outlet is directed downward in substantially a vertical direction.

57. The powder replenishing device according to claim 56, wherein a direction of reciprocating motion of the reciprocating means is set to a direction along a line connecting the one end portion and an opposite another end portion of the one side wall of the containing means.

58. The powder replenishing device according to claim 56, wherein the containing means is provided such that the one side wall of the containing means inclines downwardly toward the powder discharging outlet.

59. The powder replenishing device according to claim 56, wherein an acceleration of the containing means in the forward direction when the containing means moves in the forward direction is set to be greater than an acceleration of the containing means in the backward direction when the containing means moves in the backward direction.

60. The powder replenishing device according to claim 56, wherein an acceleration of the containing means in the backward direction produced when the containing means stops moving in the forward direction is set to be greater than an acceleration of the containing means in the forward direction when the containing means stops moving in the backward direction.

61. The powder replenishing device according to claim 60, further comprising:

means for biasing the containing means in the forward direction by a bias force thereof;

means for pressing and moving the containing means in the backward direction against the bias force of the biasing means;

means for releasing the pressing means pressing the containing means to the backward direction; and means for contacting and stopping the containing means which moves in the forward direction by the bias force of the biasing means after the releasing means has released the pressing means.

62. The powder replenishing device according to claim 61, further comprising means for supporting the containing means, wherein the stopping means is configured to be moved in the forward direction when the containing means contacts the stopping means, and wherein an elastic member is provided between the stopping means and the supporting means in the forward direction so as to bias the stopping means in the backward direction.

63. A powder conveying device, comprising:

means for conveying powder therethrough, the conveying means including one side wall and forming a powder conveying path having an inlet and an outlet, the outlet being directed downward in substantially a vertical direction; and means for substantially linearly reciprocating the conveying means between forward and backward directions with respect to a moving direction of the powder toward the outlet, the reciprocating means reciprocating the conveying means so as to move the powder in the conveying means toward the outlet, wherein the conveying means is provided such that the one side wall inclines downwardly toward the outlet.

64. The powder conveying device according to claim 63, wherein a direction of reciprocating motion of the reciprocating means is set to a direction along a line connecting one end portion and an opposite another end portion of the one side wall of the conveying means.

65. The powder conveying device according to claim 63, wherein an acceleration of the conveying means in the forward direction when the conveying means moves in the forward direction is set to be greater than an acceleration of the conveying means in the backward direction when the conveying means moves in the backward direction.

66. The powder conveying device according to claim 63, wherein an acceleration of the conveying means in the backward direction produced when the conveying means stops moving in the forward direction is set to be greater than an acceleration of the conveying means in the forward direction when the conveying means stops moving in the backward direction.

67. The powder conveying device according to claim 66, further comprising:

means for biasing the conveying means in the forward direction by a bias force thereof;

means for pressing and moving the conveying means in the backward direction against the bias force of the biasing means;

means for releasing the pressing means pressing the conveying means to the backward direction; and means for contacting and stopping the conveying means which moves in the forward direction by the bias force of the biasing means after the releasing means has released the pressing means.

68. The powder conveying device according to claim 67, further comprising a frame, wherein the stopping means is configured to be moved in the forward direction when the conveying means contacts the stopping means, and wherein an elastic member is provided between the stopping means and the frame so as to bias the stopping means in the backward direction.

* * * * *